US006806835B2

(12) United States Patent
Iwai et al.

(10) Patent No.: US 6,806,835 B2
(45) Date of Patent: Oct. 19, 2004

(54) ANTENNA STRUCTURE, METHOD OF USING ANTENNA STRUCTURE AND COMMUNICATION DEVICE

(75) Inventors: Hiroshi Iwai, Katano (JP); Atsushi Yamamoto, Osaka (JP); Koichi Ogawa, Hirakata (JP); Kenichi Yamada, Yokohama (JP); Toshihiro Asahina, Yokohama (JP); Shinji Kamaeguchi, Kadoma (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 69 days.

(21) Appl. No.: 10/279,672

(22) Filed: Oct. 24, 2002

(65) Prior Publication Data

US 2003/0117324 A1 Jun. 26, 2003

(30) Foreign Application Priority Data

Oct. 24, 2001 (JP) ..... 2001-326703

(51) Int. Cl.[7] ..... H01Q 1/24
(52) U.S. Cl. ..... 343/702
(58) Field of Search ..... 343/702, 700 MS, 343/725; 455/89, 90.3, 277.1

(56) References Cited

U.S. PATENT DOCUMENTS

| | | | | | |
|---|---|---|---|---|---|
| 5,451,965 | A | * | 9/1995 | Matsumoto | 343/702 |
| 6,011,519 | A | * | 1/2000 | Sadler et al. | 343/742 |
| 6,147,649 | A | * | 11/2000 | Ivrissimtzis et al. | 343/700 MS |
| 6,272,356 | B1 | * | 8/2001 | Dolman et al. | 455/575.3 |
| 6,307,511 | B1 | * | 10/2001 | Ying et al. | 343/702 |
| 6,545,642 | B1 | * | 4/2003 | Doub et al. | 343/702 |
| 6,600,450 | B1 | * | 7/2003 | Efanov et al. | 343/726 |
| 6,628,236 | B2 | * | 9/2003 | Kim et al. | 343/702 |
| 2002/0169010 | A1 | * | 11/2002 | Shoji et al. | 455/575 |
| 2003/0137459 | A1 | * | 7/2003 | Kim et al. | 343/702 |

* cited by examiner

*Primary Examiner*—Tan Ho
(74) *Attorney, Agent, or Firm*—RatnerPrestia

(57) ABSTRACT

An antenna structure used in a folding portable radio terminal, has a first antenna; and a second antenna, wherein the first antenna is used at least when the portable radio terminal is not folded, and the second antenna is used at least when the portable radio terminal is folded.

31 Claims, 20 Drawing Sheets

ANTENNA STRUCTURE, METHOD OF USING ANTENNA STRUCTURE AND COMMUNICATION DEVICE

BACKGROUND OF THE INVENTION

Field of the Invention

The present invention relates to an antenna structure used in a communication device, such as a folding cellular phone terminal, a method of using the antenna structure and the communication device.

Related Art of the Invention

Downsizing and slimming of cellular phone terminals are being rapidly advanced. In addition, incorporation of an antenna of a cellular phone terminal into a housing thereof is a world trend.

FIG. 19 shows a configuration of an internal antenna of a conventional cellular phone terminal.

FIG. 19(*a*) is a schematic perspective view of the internal antenna of the conventional cellular phone terminal, and FIG. 19(*b*) is a side view thereof. In FIGS. 19(*a*) and 19(*b*), an antenna element 1201 is to send or receive radio wave from the cellular phone terminal or from another cellular phone terminal, and a shielding case 1206 and a radio circuit for communication 1207 housed in the shielding case 1206 are disposed on a substrate 1202. An LCD 1203 is to display information processed in the cellular phone terminal.

The antenna element 1201 is supplied with power from a feeding point 1204 on the substrate 1202 and has an end electrically connected to a part of the substrate 1202 via a conductive connection 1205. Here, the part of the substrate 1202 and the shielding case 1206 are electrically connected to each other and form a bottom board of the antenna element 1201. Thus, the antenna element 1201, the part of the substrate 1202 and the shielding case 1206 constitutes the internal antenna.

Such a cellular phone terminal has gone beyond serving as a telephone and has been transformed to data terminal equipment that enables transmission of e-mails, browsing of WWW web pages or the like. Thus, upsizing of the display thereof is being promoted.

Under such circumstances, the folding cellular phone terminal has become popular because it is considered to be suitable for downsizing and display upsizing.

Conventionally, the folding cellular phone terminal includes a whip antenna, in addition to the internal antenna. The internal antenna and the whip antenna are used when the cellular phone terminal is folded and when it is not folded, respectively. In general, the impedances of the antennas differ according to whether the cellular phone is folded or not. Thus, the internal antenna and the whip antenna are adjusted to accommodate the difference in impedance, so that the folding cellular phone terminal has a good antenna characteristic both when it is folded and when it is not folded.

FIGS. 20(*a*)–20(*b*) show configurations of parts of the folding cellular phone terminal associated with the internal antenna. FIG. 20(*a*) is a front view of the folding cellular phone terminal and FIG. 20(*b*) is a side view thereof.

The folding cellular phone terminal has an upper housing 102 and a lower housing 103 coupled with each other by a hinge part 104, and is configured so that the upper housing 102 can be folded on the lower housing 103 via the hinge part 104.

A display 109 is incorporated in the upper housing 102, an upper bottom board 207 is incorporated in the housing at the back side of the display 109, and an upper internal antenna element 205 is incorporated in the housing on a side of the upper bottom board 207 opposite to the display 109.

However, the whip antenna is inconvenient because it needs to be drawn from the housing when the folding cellular phone is used and needs to be retracted into the housing after use. And, the whip antenna has a problem in that such drawing and retraction may cause damage thereto.

Thus, the folding cellular phone terminal has problems in that the whip antenna is burdensome because it needs to be drawn and retracted and that the whip antenna is susceptible to damage due to such operations.

In addition, in the folding cellular phone terminal shown in FIG. 20, the upper internal antenna element 205, the upper bottom board 207 and the lower bottom board 208 constitute the upper internal antenna. In this case, the upper bottom board 207 and the lower bottom board 208 are electrically connected to each other and serve as a bottom board of the upper internal antenna.

When the cellular phone terminal is folded, the antenna bottom board constituted by the upper bottom board 207 and the lower bottom board 208 is also folded. Therefore, the length of the bottom board is about half of that at the time when the cellular phone terminal 201 is not folded. In this case, if the upper bottom board 207 is shorter than a quarter of a wavelength, there is no current standing wave on the bottom board for a desired frequency band, and thus, the bottom board less contributes to radiation of the radio wave from the antenna.

Therefore, in order to use the upper internal antenna both in the states where the cellular phone terminal 201 is folded and is not folded, the antenna needs to have such a wide-band characteristic as to accommodate the difference in the impedance between the cases where it is folded and where it is not folded and the difference in the contribution of the bottom board to the radiation.

That is, since the antenna of the folding cellular phone terminal needs to have a good characteristic both when the cellular phone terminal is folded and when it is not folded, the upper internal antenna becomes large, and in particular, is increased in thickness.

Even if components in the upper housing 102 except for the upper internal antenna, such as display 109, are reduced in thickness, the thick upper internal antenna prevents the upper housing 102 from being slimmed. Similarly, even if components in the lower housing 103 except for the lower internal antenna are reduced in thickness, the thick lower internal antenna prevents the lower housing 103 from being slimmed. Thus, folding portable radio terminals including the folding cellular phone terminal have a problem in that they becomes thick if the internal antenna is used.

SUMMARY OF THE INVENTION

In consideration of the problems described above, an object of the present invention is to provide an antenna structure, a method of using the antenna structure and a communication device that eliminate the need to draw and retract an antenna when a folding portable radio terminal is to be used.

Furthermore, in consideration of the problems described above, an object of the present invention is to provide an antenna structure, a method of using the antenna structure and a communication device that enable the folding cellular phone terminal to be further slimmed.

One aspect of the present invention is an antenna structure used in a folding portable ratio terminal, comprising:

a first antenna; and a second antenna, wherein said first antenna is used at least when said portable radio terminal is not folded, and said second antenna is used at least when said portable radio terminal is folded.

Another aspect of the present invention is the antenna structure, wherein when said portable radio terminal is not folded, a diversity reception is carried out with said first antenna serving as a main antenna and said second antenna serving as a sub-antenna, and when said portable radio terminal is folded, a diversity reception is carried out with said first antenna serving as a sub-antenna and said second antenna serving as a main antenna.

Still another aspect of the present invention is the antenna structure, wherein when said portable radio terminal is not folded, a diversity transmission is carried out with said first antenna serving as a main antenna and said second antenna serving as a sub-antenna, and when said portable radio terminal is folded, a diversity transmission is carried out with said first antenna serving as a sub-antenna and said second antenna serving as a main antenna.

Yet still another aspect of the present invention is the antenna structure, wherein said first antenna has a better characteristic when said portable radio terminal is not folded, and said second antenna has a better characteristic when said portable radio terminal is folded.

Still yet another aspect of the present invention is the antenna further structure, further comprising:

a second housing part that incorporates a microphone of said portable radio terminal therein, wherein said first housing part and said second housing part are capable of being folded, said first antenna is disposed in said first housing part, and said second antenna is disposed in said second housing part.

A further aspect of the present invention is the antenna structure, wherein said first antenna is an internal antenna incorporated in said first housing part, and said second antenna is an internal antenna incorporated in said second housing part.

A still further aspect of the present invention is the antenna structure, wherein said first antenna comprises an antenna element and a bottom board for said antenna element.

A yet further aspect of the present invention is the antenna structure, wherein one of said first and second antennas, which is not used, serves as a passive element for the other, which is used.

A still yet further aspect of the present invention is the antenna structure, wherein when said first housing part and said second housing part are folded on each other, for reception, diversity reception is carried out at said first antenna and said second antenna, and for transmission, said second antenna is used with said first antenna serving as the passive element, and when said first housing part and said second housing part are not folded on each other, for reception, diversity reception is carried out at said first antenna and said second antenna, and for transmission, one of said first and second antennas which has a higher reception level is used with the other, which has a lower reception level, serving as the passive element.

An additional aspect of the present invention is the antenna structure, wherein when said first housing part and said second housing part are folded on each other, for reception, diversity reception is carried out at said first antenna and said second antenna, and for transmission, one of said first and second antennas which has a higher reception level is used with the other, which has a lower reception level, serving as the passive element, and when said first housing part and said second housing part are not folded on each other, for reception, diversity reception is carried out at said first antenna and said second antenna, and for transmission, said first antenna is used with said second antenna serving as the passive element.

A still additional aspect of the present invention is the antenna structure, wherein when said first housing part and said second housing part are folded on each other, for reception, diversity reception is carried out at said first antenna and said second antenna, and for transmission, said second antenna is used with said first antenna serving as the passive element, and when said first housing part and said second housing part are not folded on each other, for reception, diversity reception is carried out at said first antenna and said second antenna, and for transmission, said first antenna is used with said second antenna serving as the passive element.

A yet additional aspect of the present invention is the antenna structure, wherein when said first housing part and said second housing part are folded on each other, for reception, diversity reception is carried out at said first antenna and said second antenna, and for transmission, one of said first and second antennas which has a higher reception level is used with the other, which has a lower reception level, serving as the passive element, and when said first housing part and said second housing part are not folded on each other, for reception, diversity reception is carried out at said first antenna and said second antenna, and for transmission, one of said first and second antennas which has a higher reception level is used with the other, which has a lower reception level, serving as the passive element.

A still yet additional aspect of the present invention is an antenna used in a folding portable radio terminal, comprising:

a first housing part that incorporates a speaker therein;

a second housing part that incorporates a microphone therein;

a first antenna; and a second antenna, wherein said first housing part and said second housing part are capable of being folded on each other, said first antenna includes an antenna element and a bottom board for said antenna element, said antenna element is disposed in said first housing part, said bottom board is disposed over said first housing part and second housing part, for a low frequency band, said first antenna is used at least when said first housing part and said second housing part are not folded on each other, for said low frequency band, said second antenna is used at least when said first housing part and said second housing part are folded on each other, for a high frequency band, said first antenna is used at least when said first housing part and said second housing part are folded on each other, and for said high frequency band, said second antenna is used at least when said first housing part and said second housing part are not folded on each other.

A supplementary aspect of the present invention is the antenna structure, wherein for said low frequency band, said first antenna has a better characteristic when said first housing part and said second housing part are not folded on each other, and for said high frequency band, said first antenna has a better characteristic when said first housing part and said second housing part are folded on each other, and for said low frequency band, said second antenna has a better characteristic when said first housing part and said second housing part are folded on each other, and for said high frequency band, said second antenna has a better characteristic when said first housing part and said second housing part are not folded on each other.

A still supplementary aspect of the present invention is the antenna structure, wherein said antenna which is not used has a load adjusted so that said antenna which is used has a predetermined directivity and a wide band frequency characteristic.

A yet supplementary aspect of the present invention is the antenna structure, wherein a thickness of each of said first antenna and said second antenna is less than a thickness of said portable radio terminal determined by components thereof other than said first and second antennas.

A still yet supplementary aspect of the present invention is the antenna structure, wherein a part of said first housing part and/or second housing part is conductive, and said conductive part is used as said bottom board.

Another aspect of the present invention is the antenna structure, wherein a part of said first housing part is not conductive, the part facing said antenna element and extending away from a connection of said first housing part with said second housing part from an end of said antenna element opposite to the connection.

Still another aspect of the present invention is the antenna structure, wherein a part of said first housing part which faces said second antenna when said first housing part and said second housing part are folded on each other is not conductive.

Yet still another aspect of the present invention is the antenna structure, wherein whole or a part of said first antenna and/or second antenna is filled with a dielectric.

Still yet another aspect of the present invention is the antenna structure, further comprising:

a display disposed in said first housing part, wherein said display and said antenna element face each other, and a part of said display is conductive and serves also as said bottom board.

A further aspect of the present invention is the antenna structure, wherein said display includes a display main body, a frame disposed around said display main body and a reflection plate disposed at the back side of a screen of said display main body, and whole or a part of said reflection plate is conductive and serves also as said bottom board.

A still further aspect of the present invention is the antenna structure, wherein said display includes a display main body and a frame disposed around said display main body, and whole or a part of said frame is conductive and serves also as said bottom board.

A yet further aspect of the present invention is the antenna structure, further comprising:

a first housing part that incorporates a speaker of said portable radio terminal; and a second housing part that incorporates a microphone of said portable radio terminal, wherein said first housing part serves also as said first antenna, and said second antenna is a boom antenna disposed in said second housing part.

A still yet further aspect of the present invention is the antenna structure, wherein a part of said first housing part opposite to the side where the display is incorporated is made of a conductive material, and the part of said first housing part made of a conductive material serves also as said first antenna.

An additional aspect of the present invention is the antenna structure, wherein said first housing part has a slit or slot formed in said part made of a conductive material, and said first antenna and said second antenna are used for a high frequency band and a low frequency band.

A still additional aspect of the present invention is a method a using an antenna structure used in a folding portable radio terminal, the antenna structure comprising:

a first antenna; and a second antenna, wherein said first antenna is used at least when said portable radio terminal is not folded, and said second antenna is used at least when said portable radio terminal is folded.

A yet additional aspect of the present invention is a method of using an antenna structure, the antenna structure comprising:

a first housing part that incorporates a speaker therein;

a second housing part that incorporates a microphone therein;

a first antenna; and a second antenna, said first housing part and said second housing part being capable of being folded on each other, said first antenna including an antenna element and a bottom board, said antenna element being disposed in said first housing part, and said bottom board being disposed over said first housing part and second housing part, wherein for a low frequency band, said first antenna is used at least when said first housing part and said second housing part are not folded on each other, for said low frequency band, said second antenna is used at least when said first housing part and said second housing part are folded on each other, for a high frequency band, said first antenna is used at least when said first housing part and said second housing part are folded on each other, and for said high frequency band, said second antenna is used at least when said first housing part and said second housing part are not folded on each other.

A still yet additional aspect of the present invention is a communication device, comprising:

the antenna structure according to the 1st invention;

a transmitter circuit that outputs a transmission signal to said first antenna or second antenna; and a receiver circuit that receives a reception signal received at said first antenna or second antenna.

A supplementary aspect of the present invention is a communication device, comprising:

the antenna structure according to the 13th invention;

a transmitter circuit that outputs a transmission signal to said first antenna or second antenna; and a receiver circuit that receives a reception signal received at said first antenna or second antenna.

BRIEF DESCRIPTION OF THE DRAWINGS

FIG. 1(*b*) is a side view of the cellular phone terminal according to the first embodiment of this invention.

FIG. 2(*b*) is a side view of the cellular phone terminal according to the second to fourth embodiments of this invention.

FIG. 3(*b*) illustrates the cellular phone terminal according to the second embodiment of this invention, which is folded and put in a table made of iron.

FIG. 4(*b*) shows a specific example of the upper internal antenna according to the fourth embodiment of this invention at the time when the cellular phone terminal is folded.

FIG. 8(*b*) shows an antenna element of the lower internal antenna according to the fourth embodiment of this invention at the time when the cellular phone terminal is not folded, which is viewed in a direction P.

FIG. 8(*c*) shows the antenna element of the lower internal antenna according to the fourth embodiment of this invention at the time when the cellular phone terminal is not folded, which is viewed in a direction Q.

FIG. 9(*b*) shows an antenna element of the lower internal antenna according to the fourth embodiment of this invention at the time when the cellular phone terminal is not folded, which is viewed in a direction P.

FIG. 9(*c*) shows the antenna element of the lower internal antenna according to the fourth embodiment of this invention at the time when the cellular phone terminal is not folded, which is viewed in a direction Q.

FIG. 11(*b*) is a side view of the metal parts of the upper housing and lower housing of the cellular phone terminal according to the embodiments of this invention.

FIG. 11(*c*) is a side view of the metal parts of the upper housing and lower housing of the cellular phone terminal according to the embodiments of this invention.

FIG. 15(*b*) is a side view of the cellular phone terminal according to the sixth embodiment of this invention at the time when it is folded.

FIG. 16(*b*) is a side view of the cellular phone terminal according to the sixth embodiment of this invention at the time when it is not folded.

FIG. 17(*b*) is a front view of the cellular phone terminal according to the sixth embodiment of this invention which has a slit formed in a housing antenna thereof.

FIG. 19(*b*) is a schematic side view of the internal antenna of the conventional cellular phone terminal.

FIG. 20(*b*) is side view of the conventional folding cellular phone terminal only having an internal antenna.

DESCRIPTION OF SYMBOLS

101 CELLULAR PHONE TERMINAL
102 UPPER HOUSING
103 LOWER HOUSING
104 HINGE PART
105 UPPER INTERNAL ANTENNA ELEMENT
106 LOWER INTERNAL ANTENNA ELEMENT

107 UPPER BOTTOM BOARD
108 LOWER BOTTOM BOARD
109 DISPLAY
119 KEY
301*a* BOTTOM BOARD
301*b* BOTTOM BOARD
302 ANTENNA ELEMENT
303 FEEDING PART
304 SHORT-CIRCUIT PART
311*a* BOTTOM BOARD
311*b* BOTTOM BOARD
312 ANTENNA ELEMENT

PREFERRED EMBODIMENTS OF THE INVENTION

Now, embodiments of the present invention will be described with reference to the drawings.

(First Embodiment)

First, a first embodiment will be described.

Figure 1:
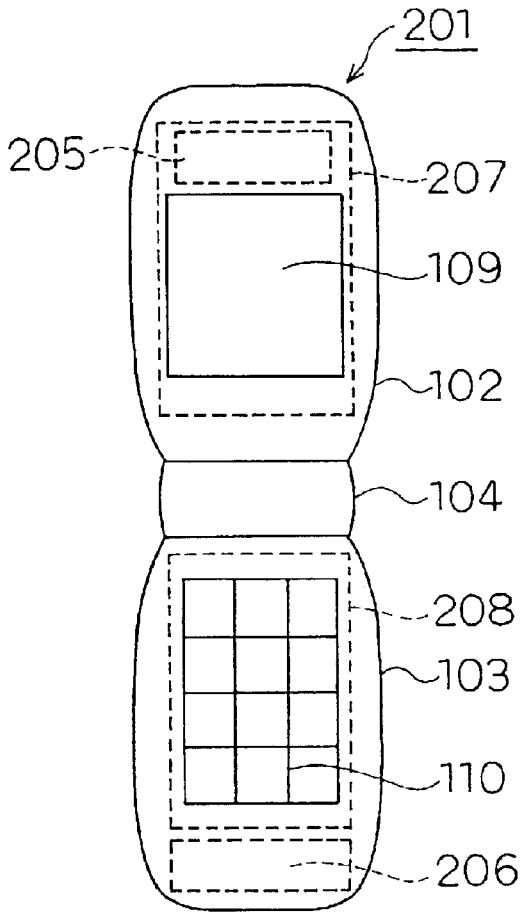
FIG. 1(*a*) is a front view of a cellular phone terminal according to a first embodiment of this invention.
Figure 1:
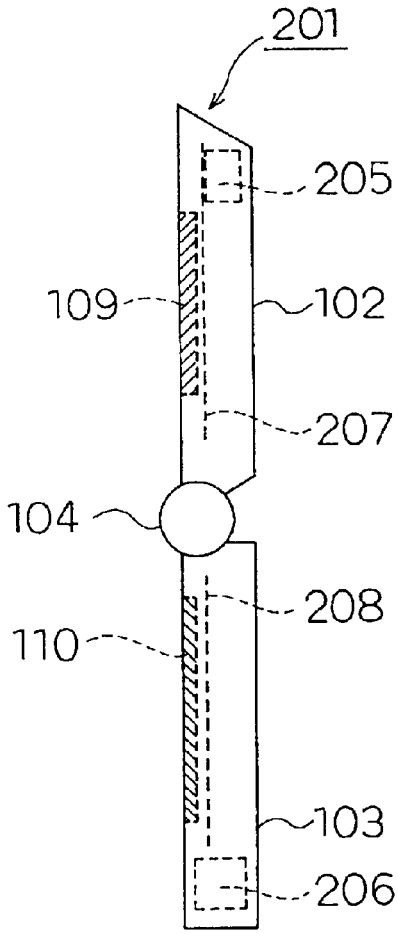

FIGS. 1(*a*)–(*b*) show configurations of folding cellular phone terminals 201 according to this embodiment. The folding cellular phone terminal 201 has an internal antenna and includes no whip antenna. FIG. 1(*a*) is a front view of the folding cellular phone terminal 201, and FIG. 1(*b*) is a side view thereof.

The folding cellular phone terminal 201 has an upper housing 102 and a lower housing 103 coupled with each other by a hinge part 104, and is configured so that the upper housing 102 can be folded on the lower housing 103 via the hinge part 104. The upper housing 102 and the lower housing 103 are electrically connected to each other via the hinge part 104.

A display 109 is incorporated in the upper housing 102, an upper bottom board 207 is incorporated in the housing at the back side of the display 109, and an upper internal antenna element 205 is incorporated in the housing on a side of the upper bottom board 207 opposite to the display 109.

The upper internal antenna element 205 and the upper bottom board 207 constitute an upper internal antenna. The upper internal antenna is adjusted to have a good characteristic both when the folding cellular phone terminal 201 is folded and when it is not folded.

A key 110 is incorporated in the lower housing 103, and a lower bottom board 208 and a lower internal antenna element 206 are incorporated in the lower housing at the back side of the key 110. In addition, a microphone (not shown) for voice input is also incorporated in the lower housing 103.

The lower internal antenna element 206 and the lower bottom board 208 constitute a lower internal antenna. The lower internal antenna is adjusted to have a good characteristic both when the folding cellular phone terminal 201 is folded and when it is not folded.

Then, an operation according to this embodiment will be described.

The cellular phone terminal 201 carries out diversity reception and transmission.

That is, the upper internal antenna and the lower internal antenna are used for diversity reception. Therefore, the upper internal antenna and the lower internal antenna are each used both when the folding cellular phone terminal 201 is folded and when it is not folded.

Since the upper internal antenna and the lower internal antenna are adjusted to have a good characteristic both when the folding cellular phone terminal 201 is folded and when it is not folded, it can relieve an instantaneous signal level drop due to a fading in a multiple transmission environment, so that interception of communication can be avoided.

Furthermore, since the cellular phone terminal 201 includes no whip antenna, there is no need to draw the whip antenna from the housing of the cellular phone terminal 201 and retract the antenna into the housing each time the cellular phone terminal 201 is used. Thus, the cellular phone terminal 201 is simple to use, and there is no fear of damage to the antenna due to the drawing and retraction thereof.

(Second Embodiment)

Now, a second embodiment will be described.

Figure 2:
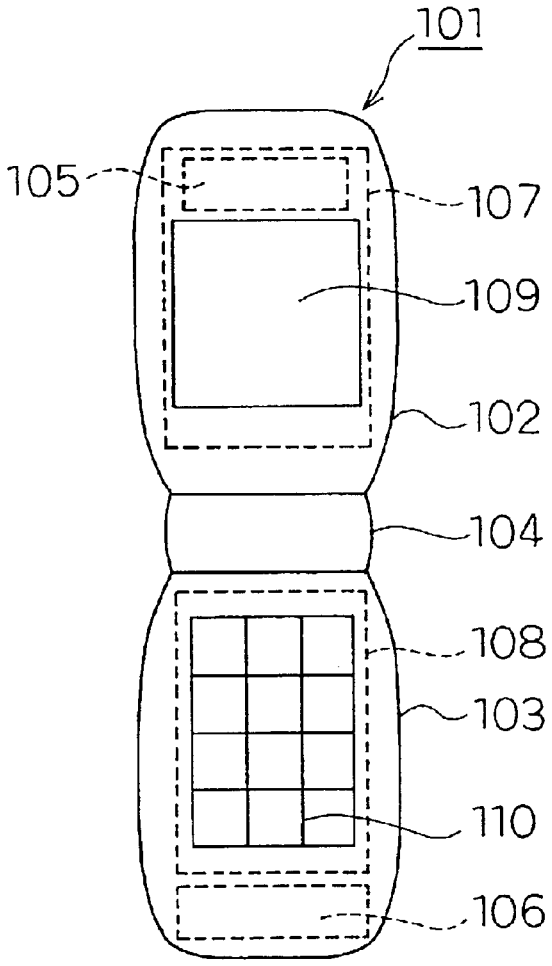
FIG. 2(*a*) is a front view of the cellular phone terminal according to second to fourth embodiments of this invention.
Figure 2:
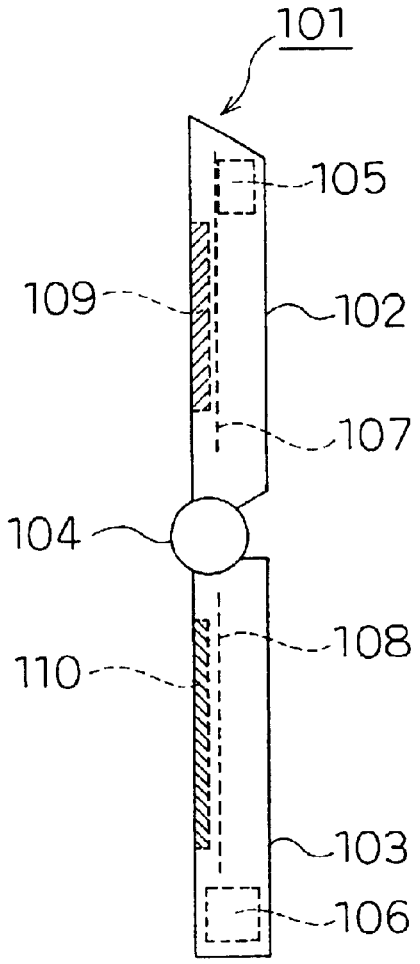

FIGS. 2(*a*)–2(*b*) show cellular phone terminals 101 according to this embodiment. FIG. 2(*a*) is a front view of the cellular phone terminal 101, and FIG. 2(*b*) is a side view thereof. The cellular phone terminal 101 is of a folding type, and the antenna thereof is only an internal antenna.

The cellular phone terminal 101 has an upper housing 102 and a lower housing 103 coupled with each other by a hinge part 104, and is configured so that the upper housing 102 can be folded on the lower housing 103 via the hinge part 104.

A display 109 is incorporated in the upper housing 102, an upper bottom board 107 is incorporated in the housing at the back side of the display 109, and an upper internal antenna element 105 is incorporated in the housing on a side of the upper bottom board 107 opposite to the display 109. The upper internal antenna element 105, the upper bottom board 107 and a lower bottom board 108 constitute an upper internal antenna. In this case, the upper bottom board 107 and the lower bottom board 108 are electrically connected to each other and serve as a bottom board of the upper internal antenna.

The upper internal antenna is adjusted to have a good characteristic when the cellular phone terminal 101 is not folded.

A key 110 is incorporated in the lower housing 103, and the lower bottom board 108 and a lower internal antenna element 106 are incorporated in the lower housing at the back side of the key 110. In addition, a microphone (not shown) for voice input is also incorporated in the lower housing 103.

The lower internal antenna element 106, the upper bottom board 107 and the lower bottom board 108 constitute a lower internal antenna. In this case, the upper bottom board 107 and the lower bottom board 108 are electrically connected to each other and serve as a bottom board of the lower internal antenna.

The lower internal antenna is adjusted to have a good characteristic when the cellular phone terminal 101 is folded.

Then, an operation according to this embodiment will be described.

The cellular phone terminal 101 according to this embodiment carries out radio communication with a base station, not shown, using a frequency band of 800 MHz-band.

If the cellular phone terminal 101 is not folded, the upper internal antenna is used. That is, the upper internal antenna is supplied with power. On the other hand, if the cellular phone terminal 101 is folded, the lower internal antenna is used. That is, the lower internal antenna is supplied with power.

When the cellular phone terminal 101 is used without being folded, the user of the cellular phone terminal 101 generally speaks over the telephone by holding the lower housing 103. At this time, the upper housing 102 is not held by a hand of the user or the like. Therefore, if the cellular phone terminal 101 is used without being folded, the upper internal antenna has a lower gain loss due to the effect of the human body than the lower internal antenna. Therefore, in this case, using the upper internal antenna can further reduce the gain loss due to the effect of the human body.

On the other hand, when the cellular phone terminal 101 is used with being folded, the user of the cellular phone terminal 101 puts it in a breast pocket or on a desk, table or the like. In this case, since the cellular phone terminal 101 is folded, the upper internal antenna is not used, and the lower internal antenna is used. Here, in this case, if the upper internal antenna serves as a passive element for the lower internal antenna and is arranged to have a predetermined directivity and a wide band frequency characteristic, such a directivity that the intensity of the transmission wave is high in the predetermined direction and the wide band frequency characteristic can be provided.

Figure 3:
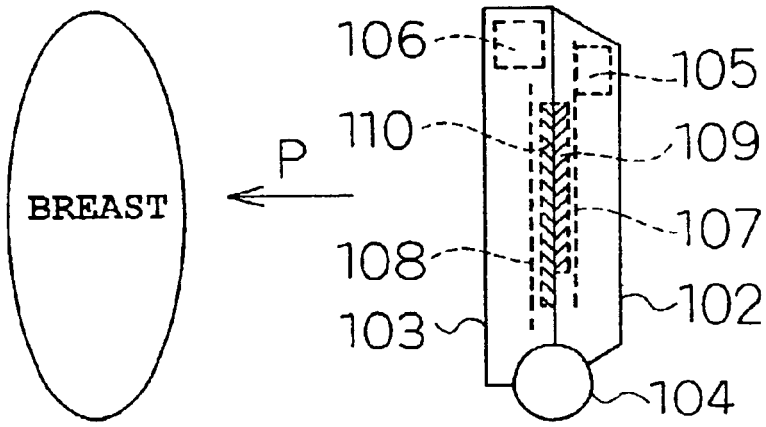
FIG. 3(*a*) illustrates the cellular phone terminal according to the second embodiment of this invention, which is folded and put in a breast pocket.
Figure 3:
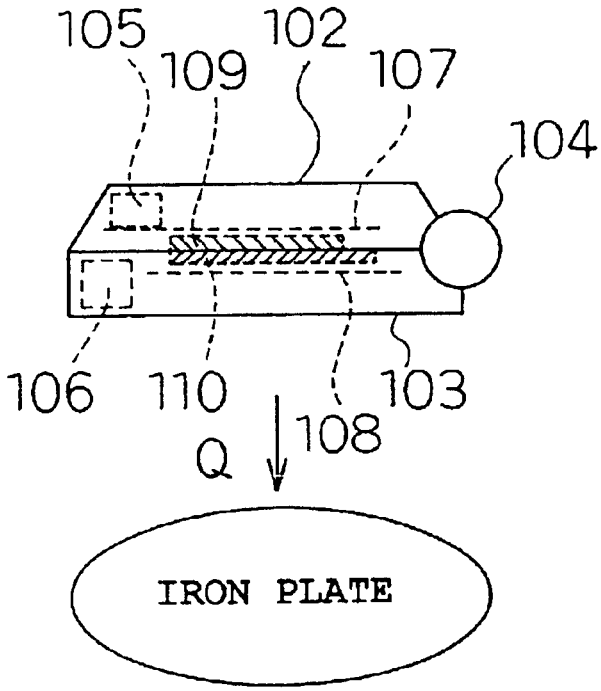

FIG. 3(*a*) shows the cellular phone terminal 101 folded and put in a breast pocket. In FIG. 3(*a*), a human breast is shown in a direction of P from the cellular phone terminal. If the lower housing 103 is located near to the human breast and the upper housing 102 is located far from the human breast, such a directivity that a transmission wave having a high intensity in the direction opposite to the breast is emitted can be provided by making the upper internal antenna serve as a passive element and adjusting the load of the passive element. Besides, it can be expected that a wide band frequency characteristic is provided by adjusting the coupling of electromagnetic fields of the upper internal antenna serving as a passive element and the lower internal antenna. Thus, when the cellular phone terminal 101 is put in the breast pocket in a state shown in FIG. 3(*a*), the gain loss due to the effect of the human body can be suppressed.

FIG. 3(*b*) shows the cellular phone terminal 101 folded and put on a table made of iron. In FIG. 3(*b*), the iron table is shown in a direction of Q. In this case, since the cellular phone terminal 101 is folded, the upper internal antenna is not used, and the lower internal antenna is used. If the lower housing 103 is located near to the iron table and the upper housing 102 is located far from the iron table, such a directivity that a transmission wave having a high intensity in the direction opposite to the iron table is emitted can be provided by making the upper internal antenna serve as a passive element and adjusting the load of the passive element. Besides, it can be expected that a wide band frequency characteristic is provided by adjusting the coupling of electromagnetic fields of the upper internal antenna serving as a passive element and the lower internal antenna. Thus, when the cellular phone terminal 101 is put on the table in a state shown in FIG. 3(*b*), the gain loss due to the effect of the table can be suppressed.

Since the upper internal antenna is used when the cellular phone terminal 101 is not folded and is not used when the cellular phone terminal 101 is folded, the upper internal antenna needs to be adjusted only to have a good characteristic when the cellular phone terminal 101 is not folded, and there is no need to adjust it to have a good characteristic when the cellular phone terminal 101 is folded.

Similarly, since the lower internal antenna is used when the cellular phone terminal 101 is folded and is not used when the cellular phone terminal 101 is not folded, the lower internal antenna needs to be adjusted only to have a good characteristic when the cellular phone terminal 101 is folded, and there is no need to adjust it to have a good characteristic when the cellular phone terminal 101 is not folded.

Therefore, the upper internal antenna and the lower internal antenna require no conventional sophisticated adjustment, are enhanced in design flexibility, and can be downsized and slimmed. Therefore, a high performance antenna can be provided at a low cost.

In this embodiment described above, the cellular phone terminal 101 is used with a frequency band of 800 MHz-band. However, it may be used with another frequency band, such as 1.5 GHz-band.

In this embodiment described above, the upper internal antenna is incorporated in the upper housing 102 and the lower internal antenna is incorporated in the lower housing 103. However, this invention is not limited thereto. The two internal antennas may be incorporated in the upper housing 102, or may be incorporated in the lower housing 103. What is essential is that one of the internal antennas is used when the cellular phone terminal is folded, and the other is used when the cellular phone terminal is not folded.

In this embodiment described above, the lower internal antenna is not used when the cellular phone terminal 101 is not folded and the upper internal antenna is not used when the cellular phone terminal 101 is folded. However, this invention is not limited thereto. If the degradation of the antenna characteristic of the upper internal antenna at the time when the cellular phone terminal 101 is folded compared with that at the time when the cellular phone terminal 101 is not folded is less than the instantaneous signal level variation due to the fading in the multiple transmission environment, it can be expected, of course, that diversity reception at the upper internal antenna and the lower internal antenna relieves the instantaneous signal level drop due to the fading and prevents the communication from being intercepted. Furthermore, if the degradation of the antenna characteristic of the lower internal antenna at the time when the cellular phone terminal 101 is not folded compared with that at the time when the cellular phone terminal 101 is folded is less than the instantaneous signal level variation due to the fading in the multiple transmission environment, it can be expected, of course, that diversity reception at the upper internal antenna and the lower internal antenna relieves the instantaneous signal level drop due to the fading and prevents the communication from being intercepted.

In this way, when the cellular phone terminal 101 is not folded, the diversity reception may be carried out with the upper internal antenna serving as a main antenna and the lower internal antenna serving as a sub-antenna, and when the cellular phone terminal 101 is folded, the diversity reception may be carried out with the upper internal antenna serving as a sub-antenna and the lower internal antenna serving as a main antenna. Furthermore, when the cellular phone terminal 101 is not folded, the diversity transmission may be carried out with the upper internal antenna serving as a main antenna and the lower internal antenna serving as a sub-antenna, and when the cellular phone terminal 101 is folded, the diversity transmission may be carried out with the upper internal antenna serving as a sub-antenna and the lower internal antenna serving as a main antenna.

Here, the "main antenna" means the antenna normally supplied with power, and the "sub-antenna" means the antenna supplied with power when the reception condition of the main antenna is degraded. Furthermore, the "diversity transmission" referred to in this embodiment means that the antenna used as the main antenna during the diversity reception is used as the transmitting antenna during transmission. Therefore, the diversity transmission in this embodiment may be applied to a case where the transmission frequency is different from the reception frequency.

When the cellular phone terminal 101 is folded, for reception, the diversity reception may carried out with the upper internal antenna with a degraded characteristic and the lower internal antenna with a good characteristic, and for transmission, the transmission wave having a high intensity in a predetermined direction may be emitted by using the lower internal antenna with the upper internal antenna serving as the passive element. And when the cellular phone terminal 101 is not folded, for reception, the diversity reception may carried out with the upper internal antenna with a good characteristic and the lower internal antenna with a degraded characteristic, and for transmission, one of the upper internal antenna and the lower internal antenna which has a higher reception level may be used with the other, which has a lower reception level, serving as the passive element.

When the cellular phone terminal 101 is folded, for reception, the diversity reception may be carried out with the upper internal antenna and the lower internal antenna, and for transmission, one of the upper internal antenna and the lower internal antenna which has a higher reception level may be used with the other, which has a lower reception level, serving as the passive element. And when the cellular phone terminal 101 is not folded, for reception, the diversity reception may be carried out with the upper internal antenna and the lower internal antenna, and for transmission, the upper internal antenna may be used with the lower internal antenna serving as the passive element.

When the cellular phone terminal 101 is folded, for reception, the diversity reception may be carried out with the upper internal antenna and the lower internal antenna, and for transmission, the lower internal antenna may be used with the upper internal antenna serving as the passive element. And when the cellular phone terminal 101 is not folded, for reception, the diversity reception may be carried out with the upper internal antenna and the lower internal antenna, and for transmission, the upper internal antenna may be used with the lower internal antenna serving as the passive element.

When the cellular phone terminal 101 is folded, for reception, the diversity reception may be carried out with the upper internal antenna and the lower internal antenna, and for transmission, one of the upper internal antenna and the lower internal antenna which has a higher reception level may be used with the other, which has a lower reception level, serving as the passive element. And when the cellular phone terminal 101 is not folded, for reception, the diversity reception may be carried out with the upper internal antenna and the lower internal antenna, and for transmission, one of the upper internal antenna and the lower internal antenna which has a higher reception level may be used with the other, which has a lower reception level, serving as the passive element.

(Third Embodiment)

Now, a third embodiment will be described.

FIG. 2 shows a cellular phone terminal 101 according to this embodiment. The cellular phone terminal 101 according to this embodiment is configured the same as that according to the second embodiment.

A variation from the second embodiment is that the cellular phone terminal 101 according to the third embodiment is of a dual band type that can be used with two frequency bands of 800 MHz-band and 1.5 GHz-band.

Except for this, the third embodiment is the same as the second embodiment.

Now, an operation according to this embodiment will be described primarily with reference to the variation from the second embodiment.

The cellular phone terminal 101 according to the third embodiment carries out radio communication with a base station, not shown, using frequency bands of 800 MHz-band and 1.5 GHz-band.

That is, when the cellular phone terminal 101 is not folded, the upper internal antenna is used both in the 800 MHz-band and 1.5 GHz-band. That is, the upper internal antenna is supplied with power. When the cellular phone terminal 101 is folded, the lower internal antenna is used both in the 800 MHz-band and 1.5 GHz-band. That is, the lower internal antenna is supplied with power.

In this way, also in the case where the two frequency band of 800 MHz-band and 1.5 GHz-bandare used, the same effect as the second embodiment can be attained.

Furthermore, since the upper internal antenna and the lower internal antenna are each used in the two frequency bands, it can be expected that the circuit in the cellular phone terminal 101 is scaled down compared with the case where each internal antenna is used in one frequency band.

(Fourth Embodiment)

Now, a fourth embodiment will be described.

FIG. 2 shows a cellular phone terminal 101 according to this embodiment. The cellular phone terminal 101 according to this embodiment is configured the same as that according to the second embodiment.

Figure 4:
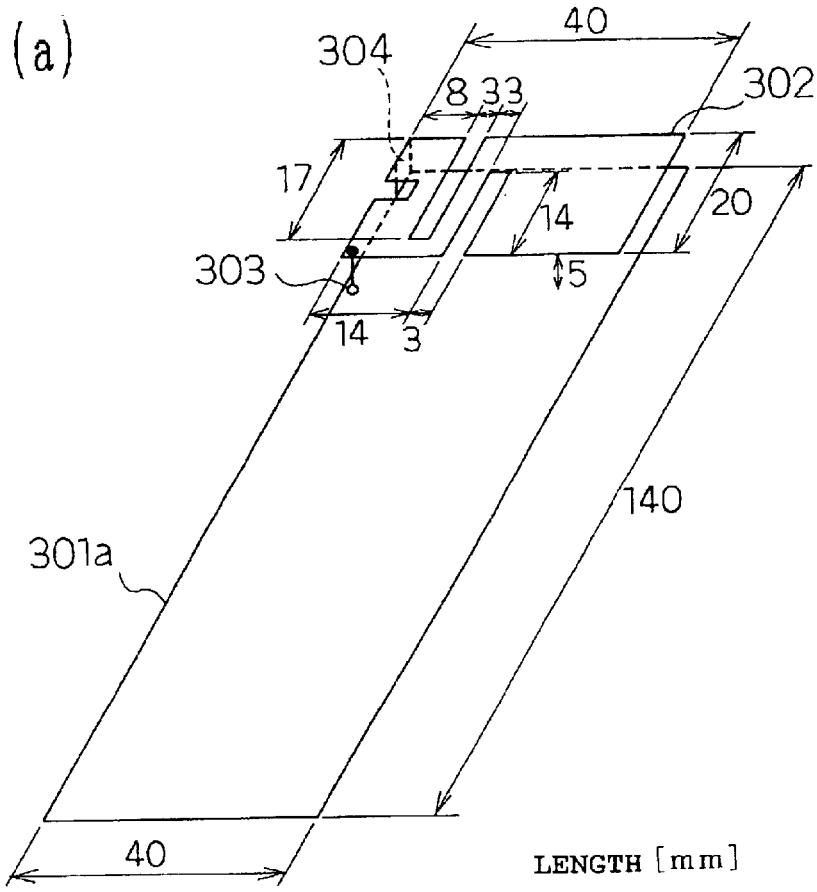
FIG. 4(*a*) shows a specific example of an upper internal antenna according to the fourth embodiment of this invention at the time when the cellular phone terminal is not folded.
Figure 4:
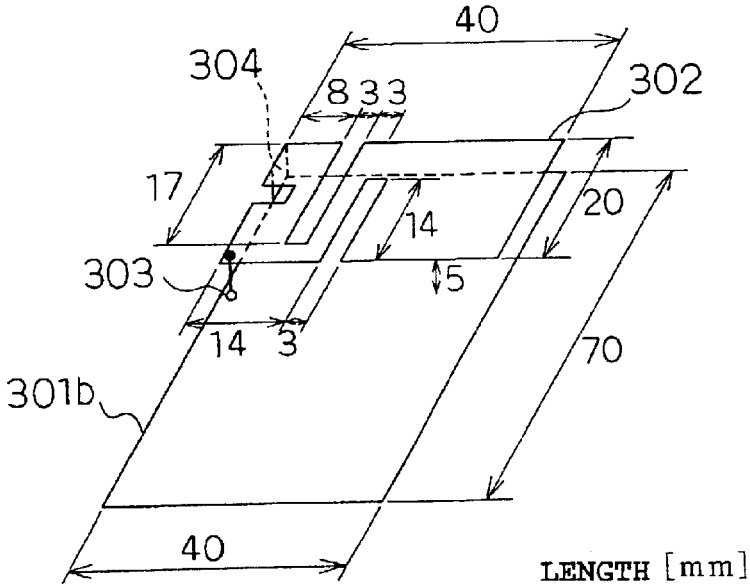

FIG. 4 shows a specific example of the upper internal antenna.

FIG. 4(*a*) shows the example of the upper internal antenna at the time when the cellular phone terminal 101 is not folded, and FIG. 4(*b*) shows the example of the upper internal antenna at the time when the cellular phone terminal 101 is folded.

When the cellular phone terminal 101 is not folded, the upper internal antenna comprises a bottom board 301*a,* an antenna element 302, a feeding part 303 and a short-circuit part 304. In the upper internal antenna shown in FIG. 4(*a*), the short-circuit part 304 is provided on an end of the bottom board 301*a* having a length of 140 mm and a width of 40 mm, and the antenna element 302 is supported by the short-circuit part 304 and disposed 5 mm above the bottom board 301*a.* The antenna element 302 is connected to one end of the feeding part 303 for supplying power to the antenna element 302 at a point in an edge thereof to which the short-circuit part 304 is attached and nearer to the center of the bottom board 301*a*. The other end of the feeding part 303 is connected to the bottom board 301*a*. The antenna element 302 has a slit extending in a width direction formed between the short-circuit part 304 and the feeding part 303 on the side thereof to which the short-circuit part 304 and the feeding part 303 are connected. In addition, it has two slits extending in a length direction. Thus, the upper internal antenna has the slits, the short circuit part 304 and the feeding part 303 adjusted in their positions to attain matching in the 800 MHz-band.

When the cellular phone terminal 101 is folded, the upper internal antenna comprises a bottom board 301*b,* the antenna element 302, the feeding part 303 and the short-circuit part 304. The bottom board 301*b* of the lower internal antenna shown in FIG. 4(*b*) has a length of 70 mm and a width of 40 mm. The length is shorter than that of the bottom board 301*a* shown in FIG. 4(*a*). This is because the upper bottom board 107 and the lower bottom board 108 are folded on each other when the cellular phone terminal 101 is folded. The remainder is the same as FIG. 4(*a*).

In this way, the upper internal antenna is configured as an inverted-F antenna in any case.

When the cellular phone terminal 101 is not folded, the bottom board 301*a* is formed by electrically connecting the upper bottom board 107 and the lower bottom board 108, shown in FIG. 2, to each other via the hinge part 104 as shown in FIG. 4(*a*). When the cellular phone terminal 101 is folded, the bottom board 301*b* is constituted by the upper bottom board 107 and the lower bottom board 108 folded on each other via the hinge part 104, as shown in FIG. 4(*b*).

Figure 8:
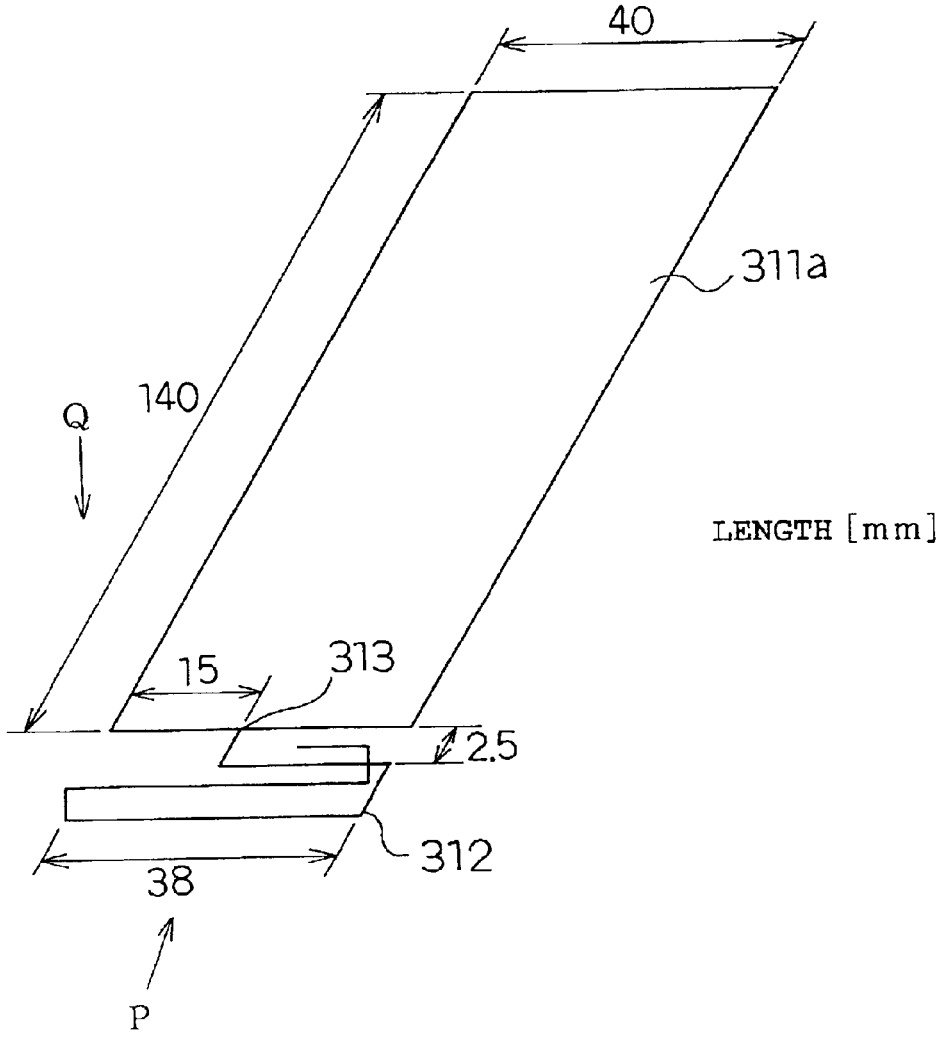
FIG. 8(*a*) is a perspective view of a lower internal antenna according to the fourth embodiment of this invention at the time when the cellular phone terminal is not folded.
Figure 8:
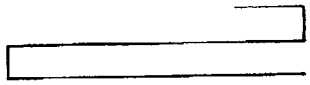
Figure 8:
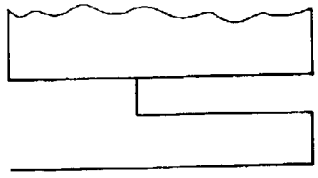
Figure 9:
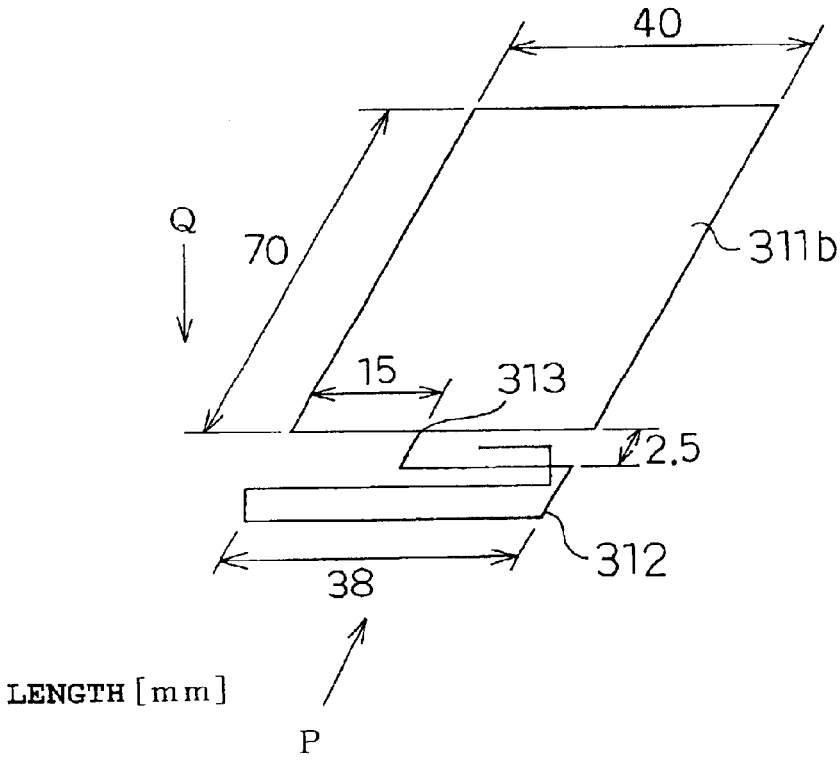
FIG. 9(*a*) is a perspective view of the lower internal antenna according to the fourth embodiment of this invention at the time when the cellular phone terminal is folded.
Figure 9:
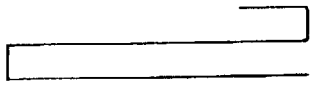
Figure 9:
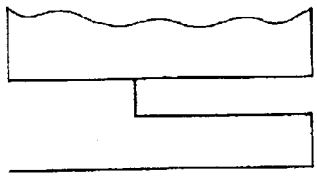

FIGS. 8 and 9 show an example of the lower internal antenna.

FIG. 8 shows the example of the lower internal antenna in the case where the cellular phone terminal 101 is not folded. FIG. 8(*a*) is a perspective view of the lower internal antenna in the case where the cellular phone terminal 101 is not folded, FIG. 8(*b*) shows an antenna element 312 viewed in a direction P in FIG. 8(*a*) and FIG. 8(*c*) shows the antenna element 312 viewed in a direction Q in FIG. 8(*a*), that is, viewed from above a bottom board 311*a*.

When the cellular phone terminal 101 is not folded, as shown in FIG. 8(*a*), the lower internal antenna comprises the grounding bottom board 311*a* and the antenna element 312. That is, a feeding part 313 is provided on a longitudinal end of the bottom board 311*a* having a length of 100 mm and a width of 400 mm, and the antenna element 312 is connected to the feeding part 313. The antenna element 312 is a helical antenna that is connected to the feeding part 313 and has a spiral shape with bends shown in FIGS. 8(*b*) and 8(*c*).

FIG. 9 shows the example of the lower internal antenna in the case where the cellular phone terminal 101 is folded. FIG. 9(*a*) is a perspective view of the lower internal antenna in the case where the cellular phone terminal 101 is folded, FIG. 9(*b*) shows the antenna element 312 viewed in the direction P in FIG. 9(*a*) and FIG. 9(*c*) shows the antenna element 312 viewed in the direction Q in FIG. 9(*a*), that is, viewed from above the bottom board 311*b*.

As shown in FIG. 9(*a*), the lower internal antenna comprises the bottom board 311*b* and the antenna element 312. The bottom board 311*b* is half the length of the bottom board 311*a* in FIG. 8(*a*).

In this way, the lower internal antenna is configured as a helical antenna in any case.

When the cellular phone terminal 101 is not folded, the bottom board 311*a* is formed by electrically connecting the upper bottom board 107 and the lower bottom board 108, shown in FIG. 2, to each other via the hinge part 104 as shown in FIG. 8(*a*). When the cellular phone terminal 101 is folded, the bottom board 311*b* is constituted by the upper bottom board 107 and the lower bottom board 108 folded on each other via the hinge part 104, as shown in FIG. 9(*a*).

Now, an operation according to this embodiment will be described.

According to this embodiment, the upper bottom board 107 and the lower bottom board 108 are electrically connected to each other and form the bottom board 301*a* shown in FIG. 4(*a*) or bottom board 311*a* shown in FIG. 8(*a*) when the cellular phone terminal 101 is not folded.

On the other hand, when the cellular phone terminal 101 is folded, the bottom board 301*b* is constituted by the upper bottom board 107 and the lower bottom board 108 folded on each other via the hinge part 104, as shown in FIG. 4(*b*). When the cellular phone terminal 101 is folded, the bottom board 311*b* is constituted by the upper bottom board 107 and the lower bottom board 108 folded on each other via the hinge part 104, as shown in FIG. 8(*b*).

In the 800 MHz-band, the upper internal antenna is used when the cellular phone terminal 101 is not folded, and the lower internal antenna is used when the cellular phone terminal 101 is folded.

Figure 5:
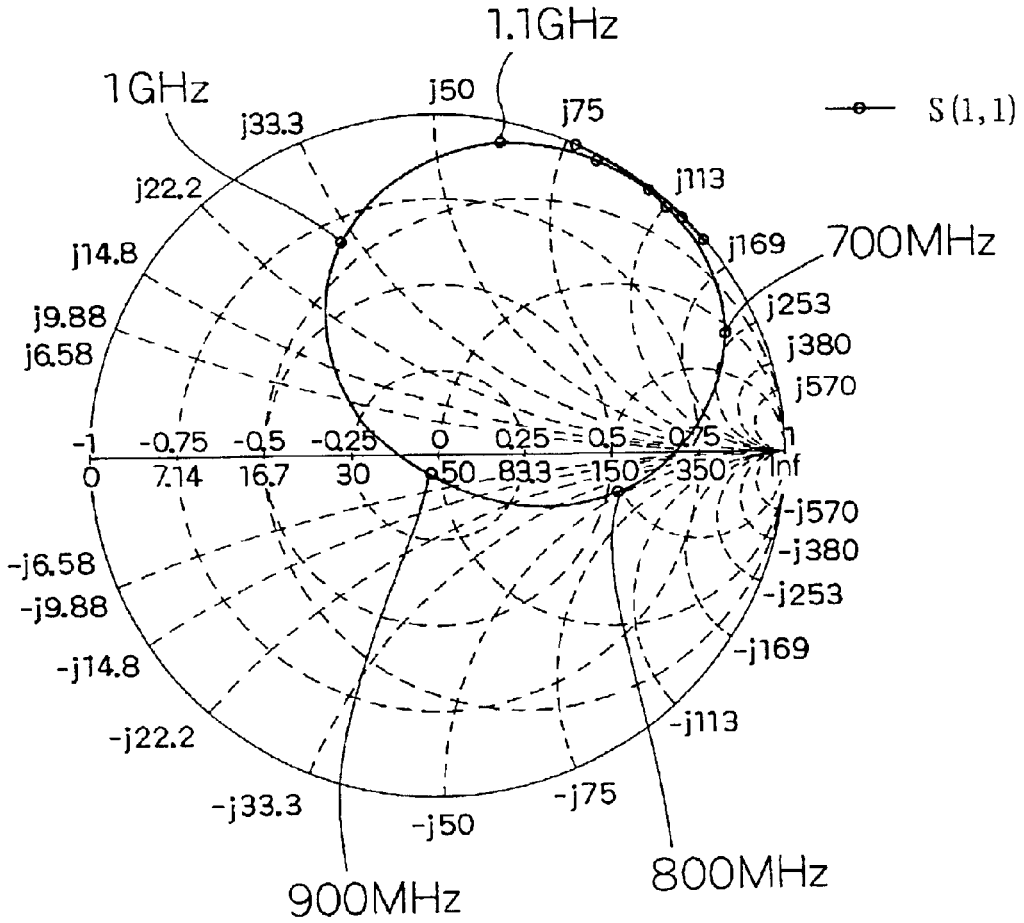
FIG. 5 is a Smith chart for the upper internal antenna according to the fourth embodiment of this invention shown in FIG. 4(*a*).
Figure 6:
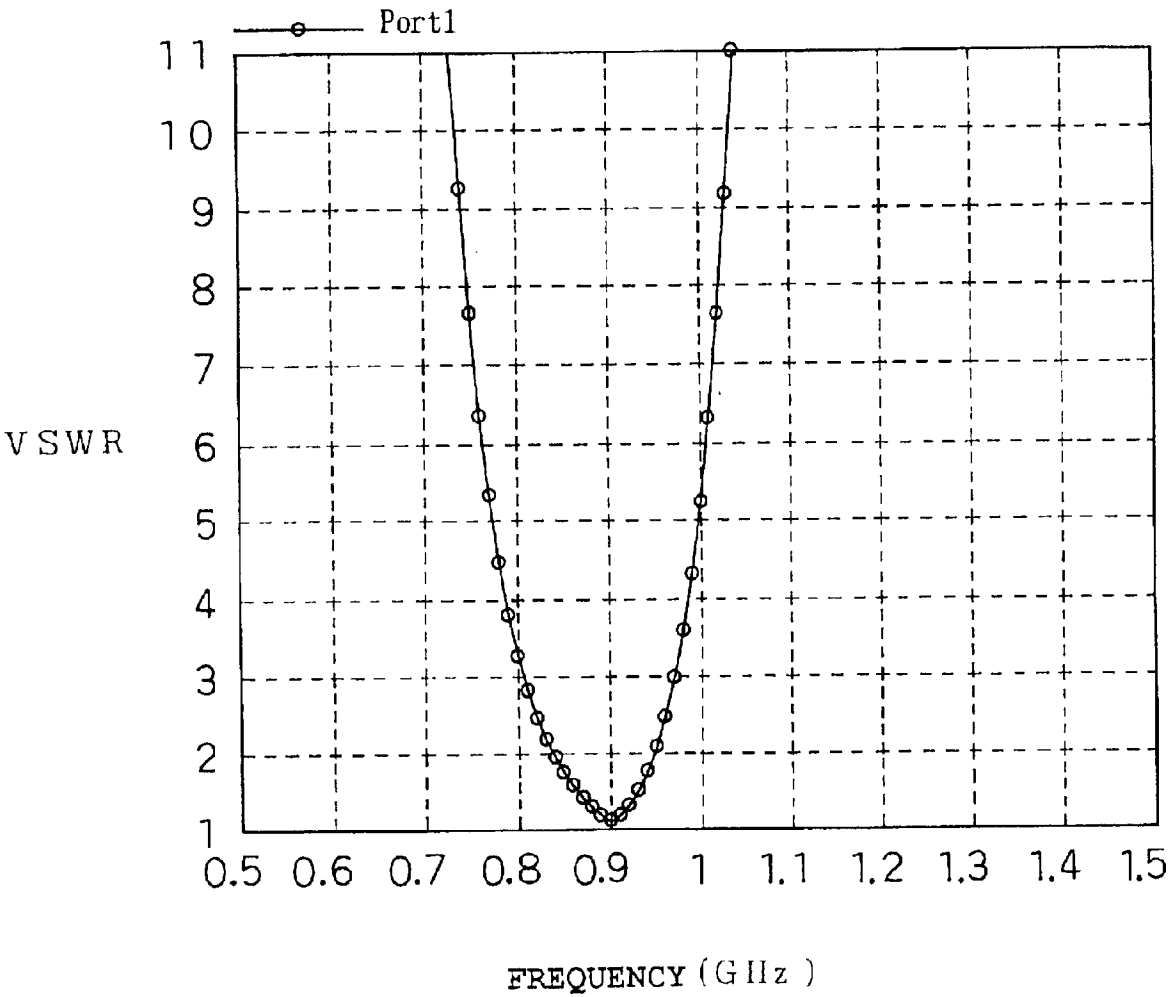
FIG. 6 shows a frequency characteristic of a VSWR of the upper internal antenna according to the fourth embodiment of this invention shown in FIG. 4(*a*).

The impedance characteristic and VSWR of such an upper internal antenna were measured by experiment. FIG. 5 is a Smith chart showing an impedance characteristic of the upper internal antenna allowing for the part from the feeding part 303 to the antenna element 302 at the time when the cellular phone terminal 101 is not folded. FIG. 6 shows a VSWR (voltage standing wave ratio) thereof. As shown in FIG. 5, the upper internal antenna has a good impedance characteristic in the vicinity of 900 MHz. Furthermore, as shown in FIG. 6, the bandwidth for which the VSWR of the upper internal antenna is 2 or less is 109 MHz. In other words, the VSWR was 2 or less in the band from 838 MHz to 947 MHz. Therefore, the center frequency of the band for which the VSWR is 2 or less was 893 MHz, and the resonance frequency at which the VSWR is minimized was 900 MHz.

Figure 7:
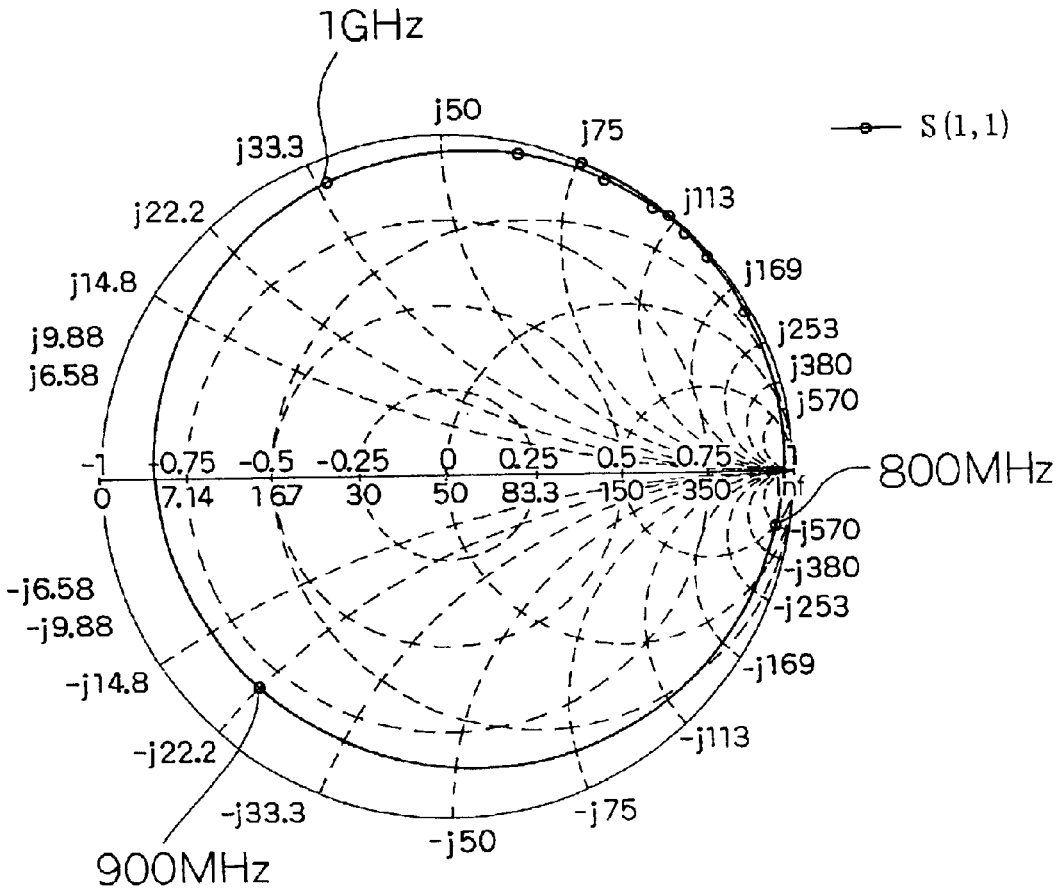
FIG. 7 is a Smith chart for the upper internal antenna according to the fourth embodiment of this invention shown in FIG. 4(*b*).

FIG. 7 is a Smith chart showing an impedance characteristic of the upper internal antenna allowing for the part from the feeding part 303 to the antenna element 302 at the time when the cellular phone terminal 101 is folded. Referring to the Smith chart in FIG. 7, from 800 MHz to 1 GHz, there is no frequency band that provides a good impedance characteristic.

That is, in the 800 MHz-band, the upper internal antenna has a better characteristic when the cellular phone terminal 101 is not folded than when it is folded.

Thus, the upper internal antenna is adjusted to have a better characteristic when the cellular phone terminal 101 is not folded than when it is folded. Therefore, unlike the conventional upper internal antenna, there is no need to adjust the upper internal antenna to have a good characteristic in both states, so that it can be slimmed compared with the conventional upper internal antenna.

For the lower internal antenna, when the cellular phone terminal 101 is not folded, the VSWR thereof allowing for the part from the feeding part 313 to the antenna element 312 was 4.5 at a frequency of 810 MHz and 4.6 at 960 MHz. On the other hand, when the cellular phone terminal 101 is folded, the VSWR thereof allowing for the part from the feeding part 313 to the antenna element 312 was 3.0 at a frequency of 810 MHz and 3.2 at 960 MHz. That is, the lower internal antenna has a better characteristic when the cellular phone terminal 101 is folded than when it is not folded Accordingly, when the cellular phone terminal 101 is not folded, the upper internal antenna is used, that is, the upper internal antenna is supplied with power. On the other hand, when the cellular phone terminal 101 is folded, the lower internal antenna is used, that is, the lower internal antenna is supplied with power. In this way, by using the lower internal antenna when the cellular phone terminal 101 is folded and using the upper internal antenna when the cellular phone terminal 101 is not folded, the cellular phone terminal 101 can be slimmed further.

In the fourth embodiment, as in the second embodiment, when the upper internal antenna is not used, if the upper internal antenna is made to serve as a passive element for the lower internal antenna and is disposed to have a predetermined directivity and a wide band frequency characteristic, such a directivity that the intensity of the transmission wave is high in the predetermined direction and the wide band frequency characteristic can be provided. Similarly, when the lower internal antenna is not used, if the lower internal antenna is made to serve as a passive element for the upper internal antenna and is disposed to have a predetermined directivity and a wide band frequency characteristic, such a directivity that the intensity of the transmission wave is high in the predetermined direction and the wide band frequency characteristic can be provided.

In addition, if a space between the antenna element 302 and the bottom board 301*a* of the upper internal antenna shown in FIG. 4 is filled with a dielectric, the strength of the upper internal antenna can be further increased, and the upper internal antenna can be further downsized owing to the wavelength shortening effect of the dielectric.

Similarly, if a space between the antenna element 312 and the bottom board 311*a* of the lower internal antenna shown in FIGS. 8 and 9 is filled with a dielectric, the strength of the lower internal antenna can be further increased, and the lower internal antenna can be further downsized owing to the wavelength shortening effect of the dielectric.

As in the case of the internal antenna described in the Prior Art, the upper bottom board 107 and the lower bottom board 108 according to this embodiment can be constituted by a part of the substrate 1202 and the shielding case 1206 electrically connected to each other.

Figure 10:
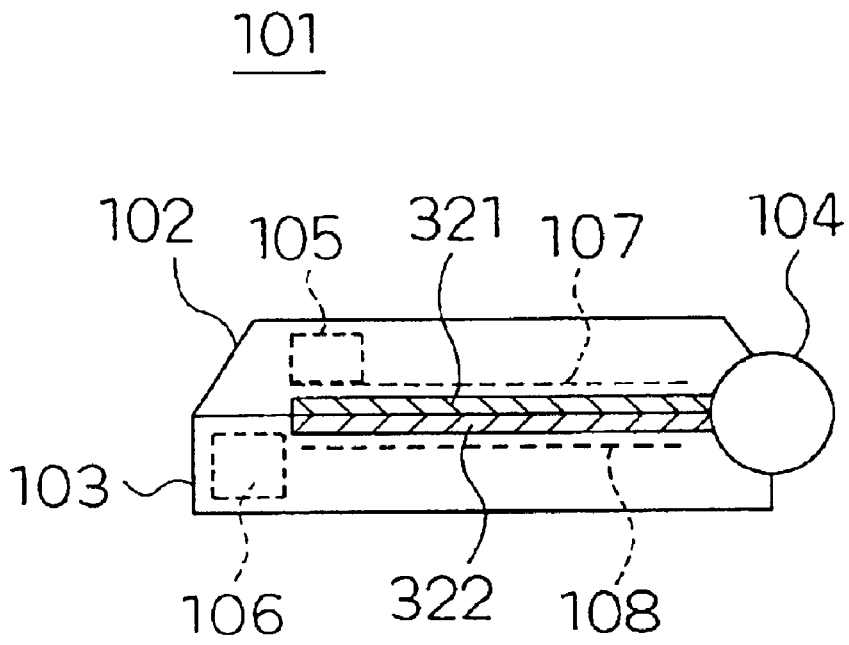
FIG. 10 shows the cellular phone terminal according to the embodiments of this invention with a part of an upper housing and a part of a lower housing being made of a conductive material.

Furthermore, as shown in FIG. 10, a part of the upper housing 102 of the cellular phone terminal 101 may be made of a conductive material, such as a metal part 321, and a part of the lower housing 103 may be made of a conductive material, such as a metal part 322. Specifically, the metal part 321 of the upper housing 102 may be made of a conductive material including a metal, such as magnesium, and the remaining part may be made of resin. Similarly, the metal part 322 of the lower housing 103 may be made of a conductive material including a metal, such as magnesium, and the remaining part may be made of resin. Then, the metal parts 321 and 322 can be made to serve as the bottom board by electrically connecting the upper bottom board 107 to the metal part 321 and the lower bottom board 108 to the metal part 322.

This increases the area serving as the bottom board and decreases the maximum value of the current density, so that the SAR (specific absorption ratio) can be further reduced.

Here, the SAR is to indicate a degree of the effect of the electromagnetic wave radiated from the cellular phone terminal 101 on a human body tissue. That is, it indicates an amount of absorbed thermal energy per unit tissue, the thermal energy being produced by a high frequency current induced in a quasi-human body by an electromagnetic wave radiated from the cellular phone terminal 101. Therefore, the SAR can be reduced by decreasing the maximum value of the current flowing through the bottom board.

Figure 11:
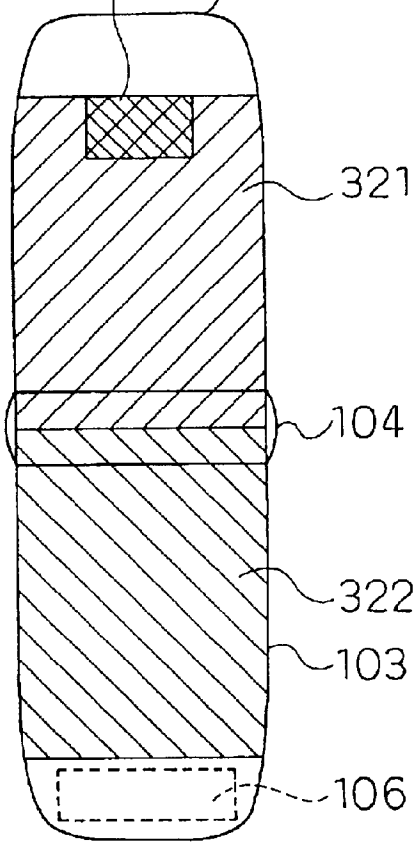
FIG. 11(*a*) is a front view of metal parts of the upper housing and lower housing of the cellular phone terminal according to the embodiments of this invention.
Figure 11:
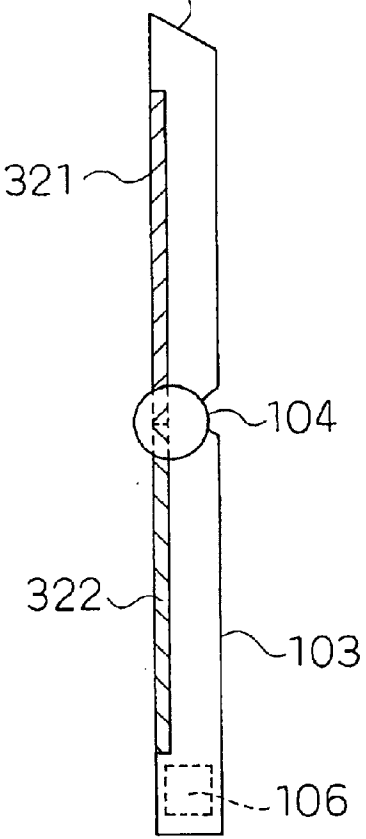
Figure 11:
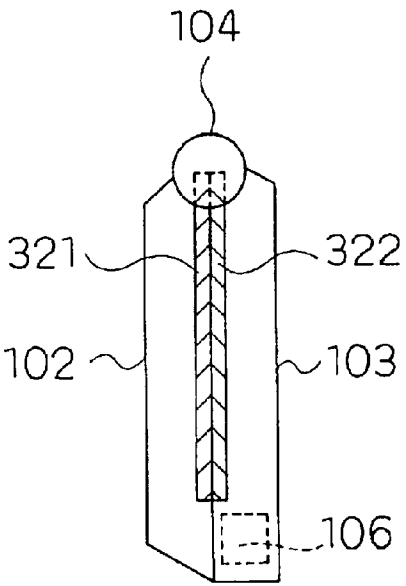

FIG. 11 shows a detailed configuration of the metal parts 321 and 322. FIG. 11(*a*) is a front view of the cellular phone terminal 101 not folded, and FIG. 11(*b*) is a side view thereof. FIG. 11(*c*) is a side view of the cellular phone terminal 101 folded. The metal part 321 is formed in such a manner that the lower internal antenna element 106 is spaced apart from the metal part 321 when the cellular phone terminal 101 is folded. Therefore, the metal part 321 is formed in such a manner that it does not overlap with the lower internal antenna element 106 when the cellular phone terminal 101 is folded. In the case where the lower antenna element 106 is configured as a line antenna, such as a helical antenna, the lower internal antenna can have a wider band by keeping a distance between the lower antenna element 106 and the bottom board.

In addition, the metal part 321 is formed in such a manner that no metal part exists beyond the upper end of the upper internal antenna 105. By disposing the upper internal antenna element 105 at the end of the bottom board, the impedance matching can be readily accomplished and a wide band characteristic can be provided.

In this way, by designing the metal parts 321 and 322 of the upper housing 102 and lower housing 103 to provide the best antenna characteristic, the strength of the cellular phone terminal 101 can be increased, and the antenna can be downsized and shortened.

While the upper bottom board 107 of the upper internal antenna is provided in this embodiment, this invention is not limited thereto and a conductive part of the display 109 may serve also as the upper bottom board 107. For example, in the case where the display 109 comprises a display main body, a frame provided around the display main body and a reflection plate provided at the back side of the screen of the display main body, the reflection plate may be made of a conductive material to serve also as the upper bottom board 107. Alternatively, the frame may be made of a conductive material to serve also as the upper bottom board 107. Furthermore, whole or a part of there flection plate, frame and upper housing may serve also as the upper bottom board 107. In such cases, there is no need to provide the upper bottom board 107, and thus, the upper internal antenna can be further shortened.

As described above, according to this embodiment, the upper internal antenna and the lower internal antenna are each used when the cellular phone terminal is folded or when it is not folded, and therefore, these antennas can be slimmed. Thus, the upper internal antenna and the lower internal antenna can have a thickness less than that determined by components other than the upper internal antenna and the lower internal antenna in the cellular phone terminal 101. As a result, the cellular phone terminal 101 can be further slimmed.

(Fifth Embodiment)

Now, a fifth embodiment will be described.

FIG. 2 shows a cellular phone terminal 101 according to this embodiment. The cellular phone terminal 101 according to this embodiment is configured the same as in the second embodiment.

A variation from the second embodiment is that the cellular phone terminal 101 according to the fifth embodiment is of a dual band type that can be used with two frequency bands of 800 MHz-band and 1.5 GHz-band.

Figure 12:
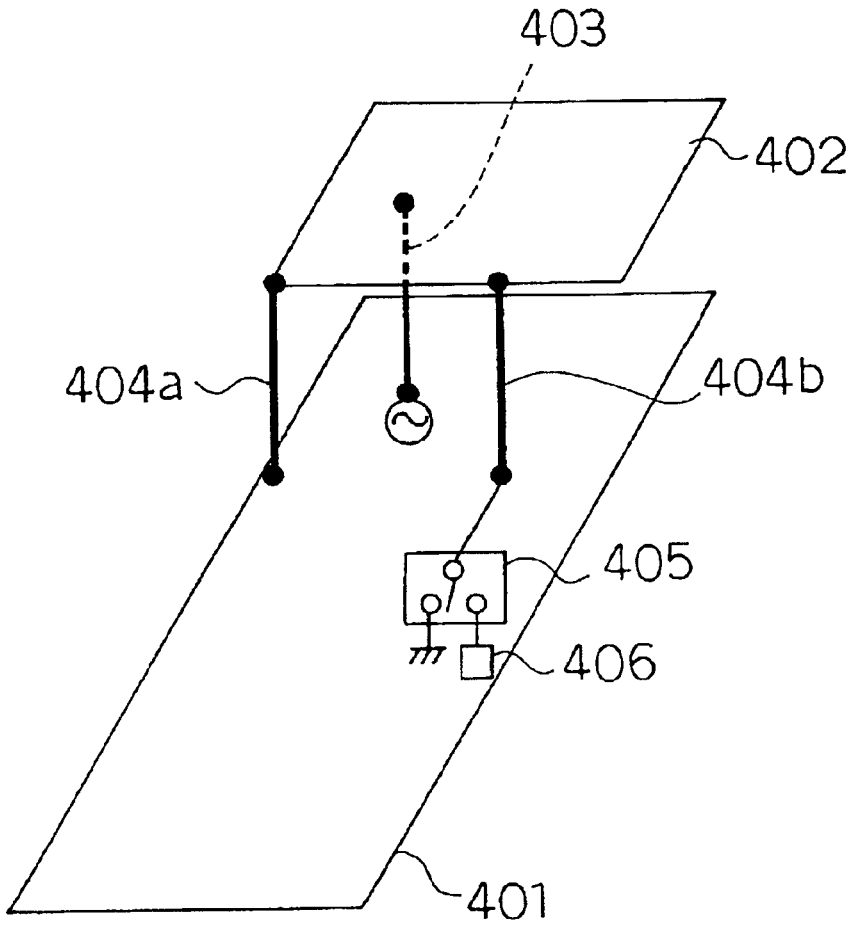
FIG. 12 shows a configuration of the upper internal antenna of the cellular phone terminal according to a fifth embodiment of this invention.

FIG. 12 shows a specific example of the upper internal antenna.

The upper internal antenna comprises a bottom board 401, an antenna element 402, a feeding part 403, a first short-circuit part 404*a*, a second short-circuit part 404*b* and a switch circuit 405.

Specifically, one end of the first short-circuit part 404*a* is connected to the bottom board 401, and one end of the second short-circuit part 404*b* is connected to the bottom board 401 via the switch circuit 405. The other end of the first short-circuit part 404*a* and the other end of the second short-circuit part 404*b* are connected to the antenna element 402. One end of the feeding part 403 is connected to the antenna element 402 and the other end thereof is connected to the bottom board 401. One terminal of the switch circuit 405 is connected to the bottom board 401 and another terminal thereof is connected to a reactance load 406.

Figure 13:
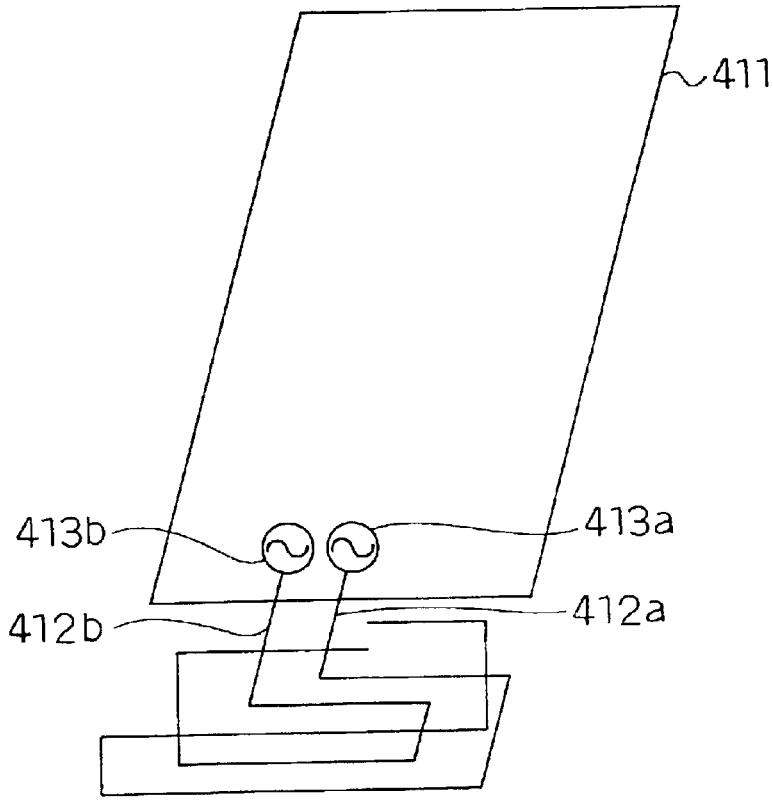
FIG. 13 shows a configuration of the lower internal antenna of the cellular phone terminal according to a fifth embodiment of this invention.
Figure 13:
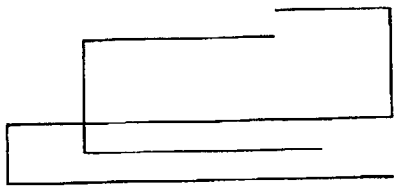
Figure 13:
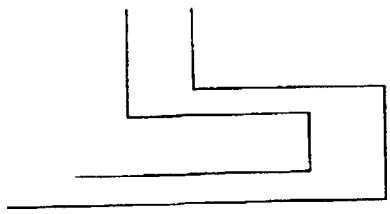

FIG. 13 shows an example of the lower internal antenna.

In the lower internal antenna, an antenna element 412*a*, which is a helical antenna having a spiral shape with bends for the 800 MHz-band, is connected to a bottom board 411 via a feeding part 413*a* for the 800 MHz-band, and an antenna element 412*b*, which is a helical antenna having a spiral shape with bends for the 1.5 GHz-band, is connected to the bottom board 411 via a feeding part 413*b* for the 1.5 GHz-band. That is, the lower internal antenna in FIG. 13 is the lower internal antenna shown in FIG. 8 additionally provided with the antenna element for the 1.5 GHz-band.

The lower internal antenna is configured as a helical antenna having a spiral shape with bends in any case.

Figure 14:
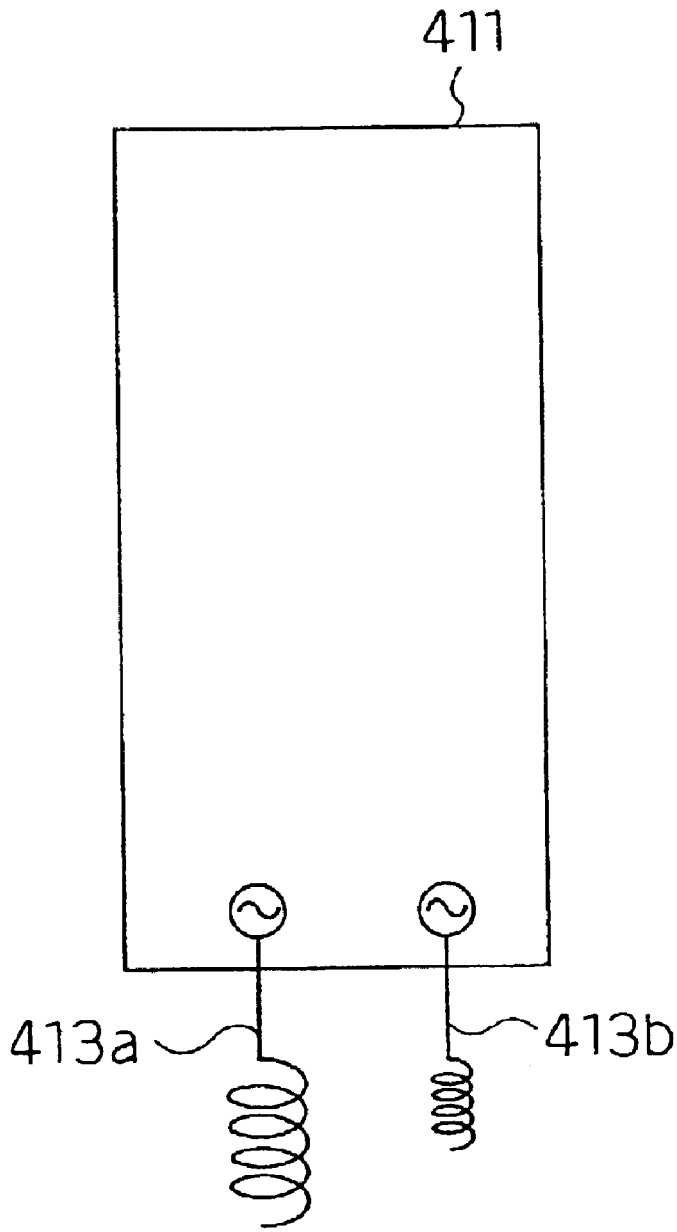
FIG. 14 shows another configuration of the lower internal antenna of the cellular phone terminal according to a fifth embodiment of this invention.

The lower internal antenna may be one shown in FIG. 14. The antenna shown in FIG. 14 is the same as the antenna shown in FIG. 13 except that parts equivalent to the antenna elements 412*a* and 412*b* in FIG. 13 are in a spiral shape with no bend.

When the cellular phone terminal 101 is not folded, as in the fourth embodiment, the bottom board 411 is formed by electrically connecting the upper bottom board 107 and the lower bottom board 108, shown in FIG. 2, to each other via the hinge part 104. When the cellular phone terminal 101 is folded, the bottom board 411 is constituted by the upper bottom board 107 and the lower bottom board 108 folded on each other via the hinge part 104.

Now, an operation according to this embodiment will be described.

According to this embodiment, the upper bottom board 107 and the lower bottom board 108 are electrically connected to each other and form the bottom board 401 shown in FIG. 12 or bottom board 411 shown in FIG. 13 when the cellular phone terminal 101 is not folded. On the other hand, when the cellular phone terminal 101 is folded, the bottom board 401 is constituted by the upper bottom board 107 and the lower bottom board 108 folded on each other via the hinge part 104, as shown in FIG. 12. When the cellular phone terminal 101 is folded, the bottom board 411 is constituted by the upper bottom board 107 and the lower bottom board 108 folded on each other via the hinge part 104, as shown in FIG. 13.

In the 800 MHz-band, the upper internal antenna is used when the cellular phone terminal 101 is not folded, and the lower internal antenna is used when the cellular phone terminal 101 is folded.

On the other hand, in the 1.5 GHz-band, the upper internal antenna is used when the cellular phone terminal 101 is folded, and the lower internal antenna is used when the cellular phone terminal 101 is not folded.

For the 800 MHz-band, the switch of the upper internal antenna is turned to the reactance load 406, and the upper internal antenna in FIG. 12 is used as an inverted-F antenna. On the other hand, for the 1.5 GHz-band, the switch of the upper internal antenna is turned to the terminal connected to the bottom board 401 to short-circuit the second short-circuit part 404*b* to the bottom board 401. In this way, the upper internal antenna in FIG. 12 is used as an inverted-F antenna of two-points short-circuit type.

As for the lower internal antenna, when used in the 800 MHz-band, the antenna element 412*a* is used by supplying power to the feeding part 413*a*. And, when used in the 1.5 GHz-band, the antenna element 412*b* is used by supplying power to the feeding part 413*b*.

Thus, in the frequency band of the 800 MHz-band, the upper internal antenna has a better characteristic when the cellular phone terminal 101 is not folded, and in the frequency band of the 1.5 GHz-band, it has a better characteristic when the cellular phone terminal 101 is folded. And, in the frequency band of the 800 MHz-band, the lower internal antenna has a better characteristic when the cellular phone terminal 101 is folded, and in the frequency band of the 1.5 GHz-band, it has a better characteristic when the cellular phone terminal 101 is not folded.

When the cellular phone terminal 101 is not folded, the upper internal antenna shown in FIG. 12 is used in the 800 MHz-band. In this case, the bottom board 401 is formed by electrically connecting the upper bottom board 107 and the lower bottom board 108 to each other. Since the bottom board 401 can have a sufficient size, the characteristic thereof can be improved. For the 1.5 GHz-band, however, if the bottom board 401 is formed by connecting the upper bottom board 107 and the lower bottom board 108 to each other, the bottom board 401 is too large, and thus, the band of the upper internal antenna becomes narrower. Thus, for the 1.5 GHz-band, the upper internal antenna is not used when the cellular phone terminal 101 is not folded, and the upper internal antenna is used only when the cellular phone terminal 101 is folded.

As described above, since a better one can be selected among conditions of the bottom board for each frequency, a wider band and a higher efficiency can be realized.

(Sixth Embodiment)

Figure 15:
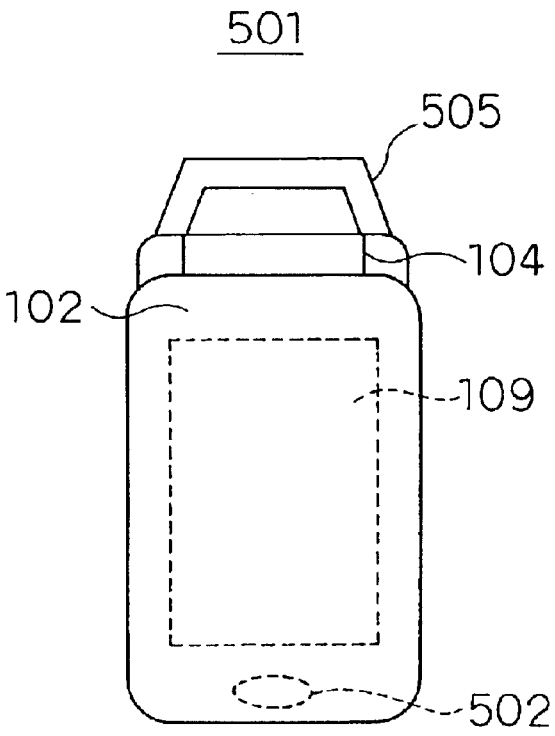
FIG. 15(*a*) is a front view of the cellular phone terminal according to a sixth embodiment of this invention at the time when it is folded.
Figure 15:
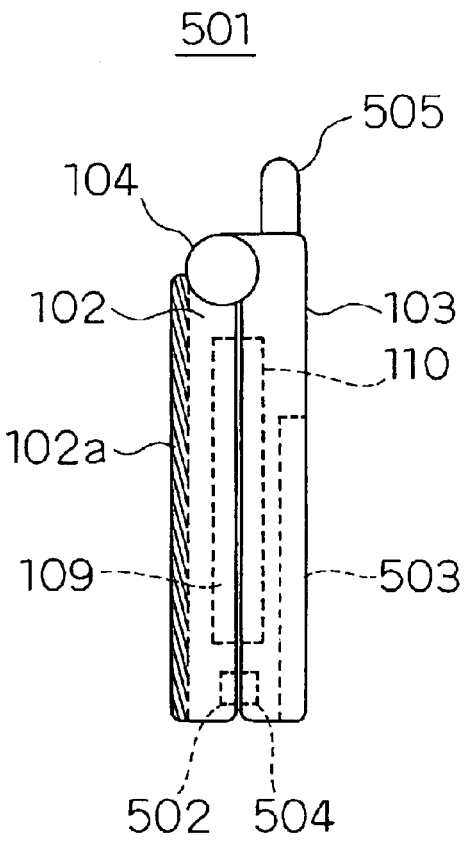
Figure 16:
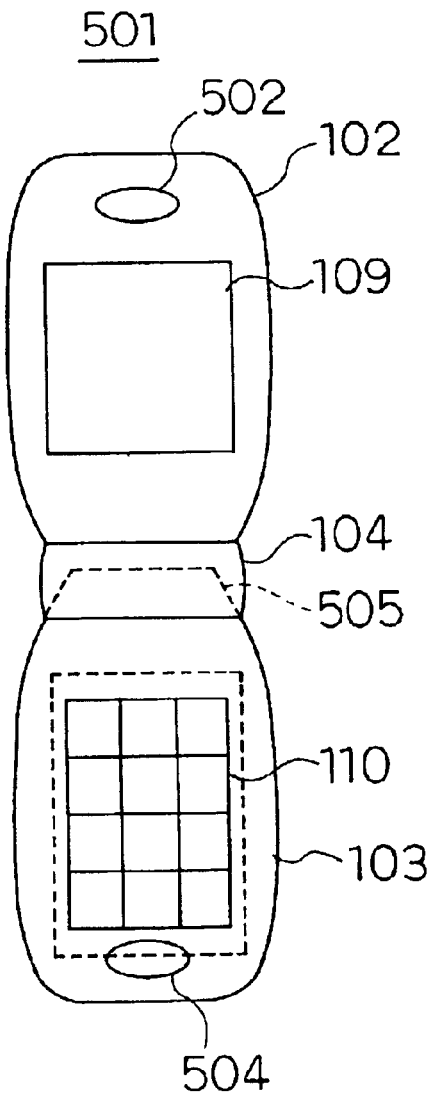
FIG. 16(*a*) is a front view of the cellular phone terminal according to the sixth embodiment of this invention at the time when it is not folded.
Figure 16:
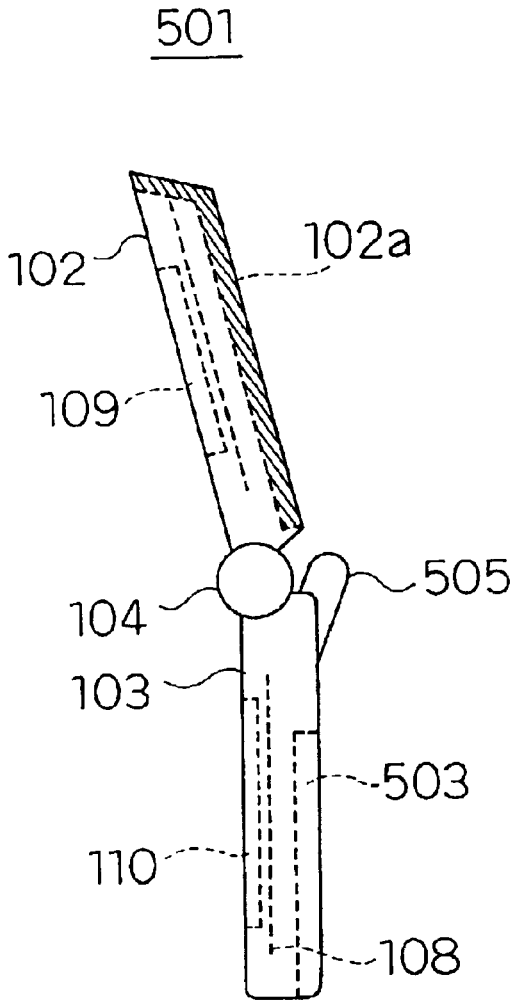

FIGS. 15 and 16 show a cellular phone terminal 501 according to a sixth embodiment. The cellular phone terminal 501 according to this embodiment is of the folding type as in the embodiments described above. FIG. 15(*a*) is a front view of the cellular phone terminal 501 folded, and FIG. 15(*b*) is a side view thereof. FIG. 16(*a*) is a front view of the cellular phone terminal 501 not folded, and FIG. 16(*b*) is a side view thereof.

The cellular phone terminal 501 has an upper housing 102 and a lower housing 103 coupled with each other by a hinge part 104, and is configured so that the upper housing 102 can be folded on the lower housing 103 via the hinge part 104.

The upper housing 102 has a display 109 incorporated therein and a sound hole 502 for audio output formed therein. The back side of the upper housing 102 opposite to the display 109 is made of a metal, such as magnesium, to constitute a housing antenna 102*a*. In this case, the housing antenna 102*a* and the lower bottom board 108 are electrically separated from each other, and the lower bottom board 108 serves as the bottom board of the housing antenna 102*a*.

The housing antenna 102*a* is adjusted to have a good characteristic when the cellular phone terminal 501 is not folded.

The lower housing 103 has a key 110 incorporated therein, a lower bottom board 108 incorporated therein at the back side of the key 110, and a microphone 504 for audio input incorporated therein on the side of the key 110 opposite to the hinge part 104. In addition, a boom antenna 505 is disposed on the side of the hinge part 104 opposite to the key 110. The lower bottom board 108 serves also as a bottom board of the boom antenna.

The boom antenna 505 is adjusted to have a good characteristic when the cellular phone terminal 501 is folded.

Then, an operation according to this embodiment will be described.

The cellular phone terminal 501 according to this embodiment carries out radio communication with a base station, not shown, using the frequency band of the 800 MHz-band.

If the cellular phone terminal 501 is not folded, the housing antenna 102*a* is used. That is, the housing antenna 102*a* is supplied with power. On the other hand, if the cellular phone terminal 501 is folded, the boom antenna 505 is used. That is, the boom antenna 505 is supplied with power.

When the cellular phone terminal 501 is used without being folded, the user of the cellular phone terminal 501 generally speaks over the telephone by holding the lower housing 103. At this time, the upper housing 102 is not held by a hand of the user or the like. Therefore, if the cellular phone terminal 501 is used without being folded, the housing antenna 102*a* has a lower gain loss due to the effect of the human body than the boom antenna 505. Therefore, in this case, using the housing antenna 102*a* can further reduce the gain loss due to the effect of the human body.

On the other hand, when the cellular phone terminal 501 is used with being folded, the user of the cellular phone terminal 501 puts it in a breast pocket or on a desk, table or the like. In this case, since the cellular phone terminal 501 is folded, the housing antenna 102*a* is not used, and the boom antenna 505 is used.

Since the housing antenna 102*a* is used when the cellular phone terminal 501 is not folded and is not used when the cellular phone terminal 501 is folded, the housing antenna 102*a* needs to be adjusted only to have a good characteristic when the cellular phone terminal 501 is not folded, and there is no need to adjust it to have a good characteristic when the cellular phone terminal 501 is folded.

Similarly, since the boom antenna 505 is used when the cellular phone terminal 501 is folded and is not used when the cellular phone terminal 501 is not folded, the boom antenna 505 needs to be adjusted only to have a good characteristic when the cellular phone terminal 501 is folded, and there is no need to adjust it to have a good characteristic when the cellular phone terminal 501 is not folded.

Therefore, the housing antenna 102*a* and the boom antenna 505 require no conventional sophisticated adjustment, are enhanced in design flexibility, and can be downsized and slimmed. Therefore, a high performance antenna can be provided at a low cost. Furthermore, since apart of the upper housing 102 is made of a metal, such as magnesium, so that the housing antenna 102*a* serves as the housing and the antenna, there is no need to provide a separate upper antenna element in the upper housing 102, and the upper housing 102 can be shortened accordingly.

Alternatively, a part of the upper housing on the side of the display 109 may be made of a metal to serve also as an antenna element. If the part of the upper housing on the side of the display 109 may be made of a metal to serve also as an antenna element, the strength of the display 109 can advantageously increased. However, if the back side of the upper housing opposite to the display 109 is made of a metal, such as magnesium, to constitute the housing antenna 102*a* serving as the housing and the antenna as described in this embodiment, the distance between the housing antenna 102*a* and an ear of the user is increased compared to the case where the part of the upper housing on the side of the display 109 may be made of a metal to serve also as an antenna element. Therefore, a reduced current flows through the ear, so that the effect of the current on the user's body can be reduced.

If the back side of the upper housing 102 is made of a metal, such as magnesium, to constitute the housing antenna 102*a,* the display 109 is made of resin and the holder (frame) of the display 109 is made of a metal, the mechanical strength and stability of the cellular phone terminal 501 can be increased.

In this embodiment described above, the cellular phone terminal 501 communicates with a base station, not shown with the frequency band of the 800 MHz-band. However, it may be used with two frequency bands of the 800 MHz-band and the 1.5 GHz-band.

Figure 17:
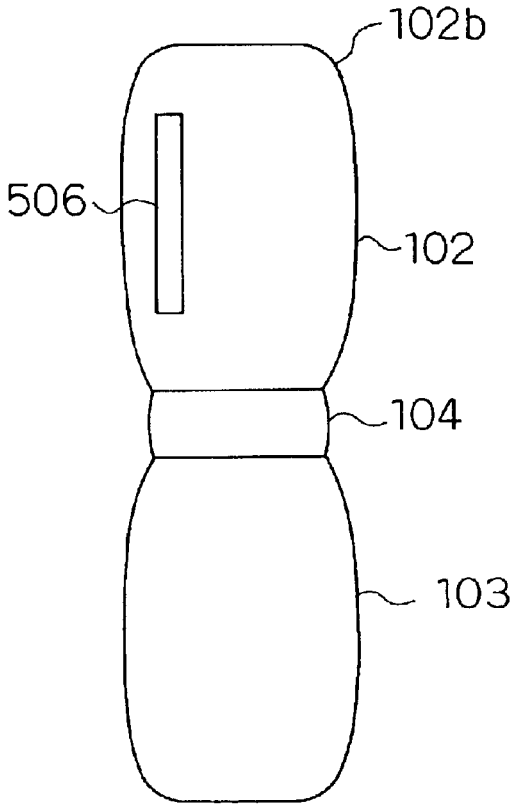
FIG. 17(*a*) is a front view of the cellular phone terminal according to the sixth embodiment of this invention which has a slot formed in a housing antenna thereof.
Figure 17:
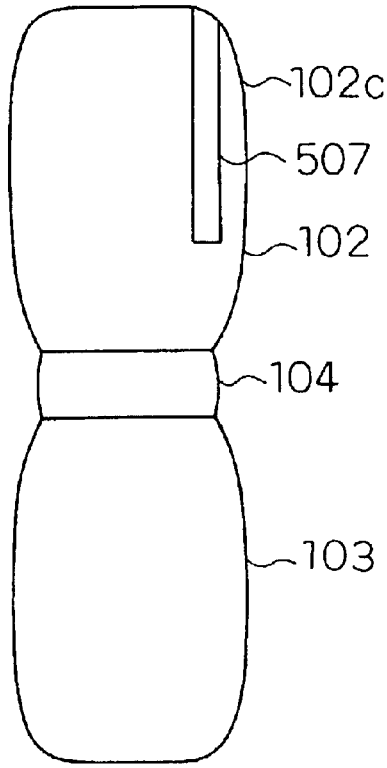

FIGS. 17(*a*) and 17(*b*) show housing antennas 102*b* and 102*c,* respectively, that can be used with the two frequency bands. The housing antenna 102*b* shown in FIG. 17(*a*) has a slot 506 having a length of about $\lambda/2$, where the wavelength for the 1.5 GHz-band is $\lambda$. The housing antenna 102*c* shown in FIG. 17(*b*) has a slit 507 having a length of about $\lambda/4$, where the wavelength for the 1.5 GHz-band is $\lambda$.

In this way, owing to the configuration that enables the housing antennas 102*b,* 102*c* to be used with two frequency bands and a matching circuit provided in a radio circuit in the cellular phone terminal 501, the housing antennas 102*b* and 102*c* can be matched with the radio circuit even if switching between the two frequency bands is done.

In this embodiment described above, the cellular phone terminal 501 is used with the frequency band of the 800 MHz-band. However, it may be used with another frequency band, such as 1.5 GHz-band.

In this embodiment described above, the housing antenna is used with the two frequency bands of the 800 MHz-band and the 1.5 GHz-band. However, this embodiment may be applied to a case where it is used with two frequency bands other than the 800 MHz-band and the 1.5 GHz-band.

In this embodiment described above, the boom antenna 505 is not used when the cellular phone terminal 501 is not folded and the housing antenna 102*a* is not used when the cellular phone terminal 501 is folded. However, this invention is not limited thereto. If the variation between the characteristic of the boom antenna 505 at the time when the cellular phone terminal 501 is not folded and the characteristic of the housing antenna 102*a* at the time when the cellular phone terminal 501 is not folded is less than the instantaneous signal level variation due to the fading in the multiple transmission environment, it can be expected, of course, that diversity reception at the housing antenna 102*a* and the boom antenna 505 relieves the instantaneous signal level drop due to the fading and prevents the communication from being intercepted. Furthermore, if the variation between the characteristic of the housing antenna 102*a* at the time when the cellular phone terminal 501 is folded and the characteristic of the boom antenna 505 at the time when the cellular phone terminal 501 is folded is less than the instantaneous signal level variation due to the fading in the multiple transmission environment, it can be expected, of course, that diversity reception at the housing antenna 102*a* and the boom antenna 505 relieves the instantaneous signal level drop due to the fading and prevents the communication from being intercepted.

In this way, when the cellular phone terminal 501 is not folded, the diversity reception may be carried out with the housing antenna 102*a* serving as a main antenna and the boom antenna 505 serving as a sub-antenna, and when the cellular phone terminal 501 is folded, the diversity reception may be carried out with the housing antenna 102*a* serving as a sub-antenna and the boom antenna 505 serving as a main antenna. Furthermore, when the cellular phone terminal 501 is not folded, the diversity transmission may be carried out with the housing antenna 102*a* serving as a main antenna and the boom antenna 505 serving as a sub-antenna, and when the cellular phone terminal 501 is folded, the diversity transmission may be carried out with the housing antenna 102*a* serving as a sub-antenna and the boom antenna 505 serving as a main antenna. Here, the main antenna and the sub-antenna are the same as those described in the first embodiment.

(Seventh Embodiment)

Figure 18:
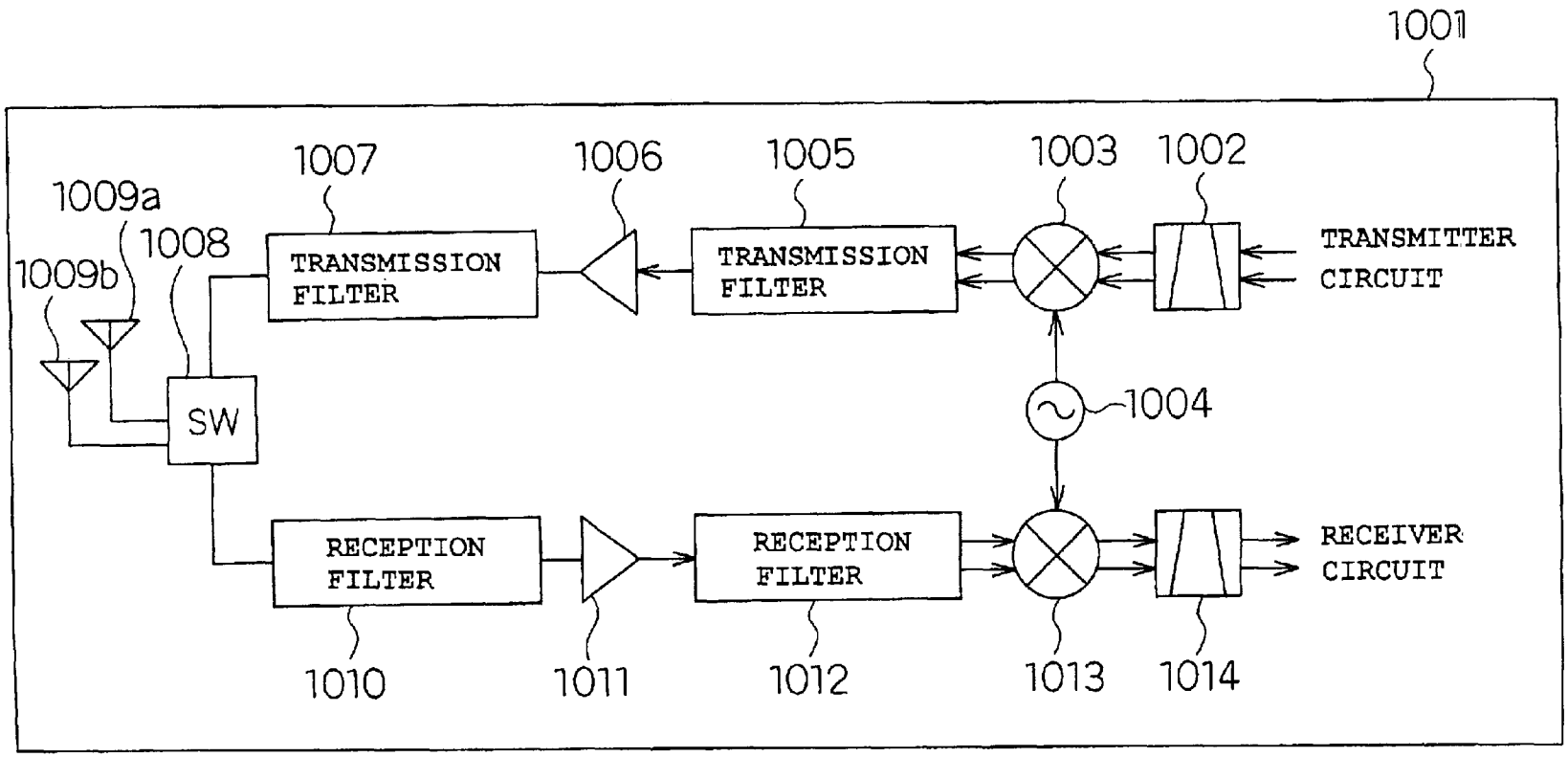
FIG. 18 is a block diagram showing a configuration of a communication device according to a seventh embodiment of this invention.
Figure 19:
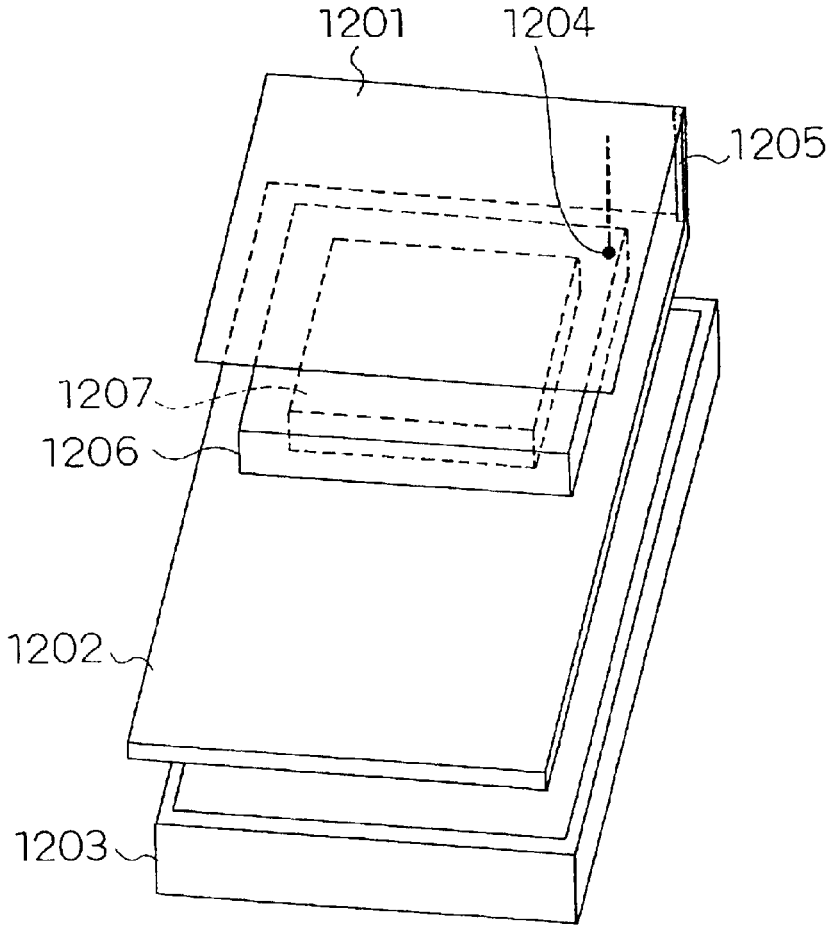
FIG. 19(*a*) is a schematic perspective view of an internal antenna of a conventional cellular phone terminal.
Figure 19:
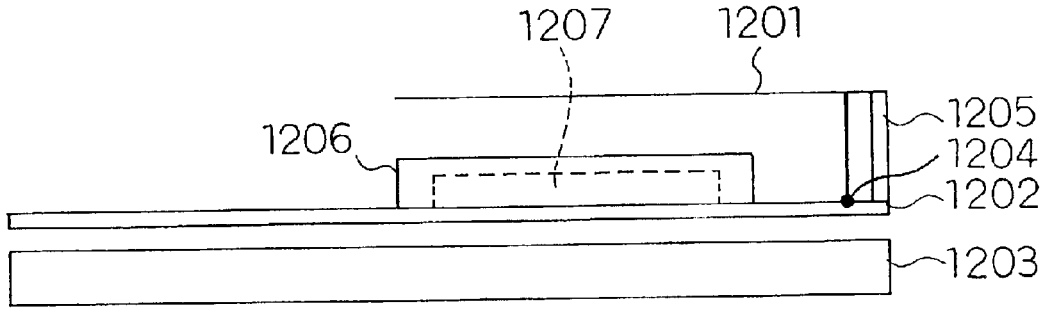
Figure 20:
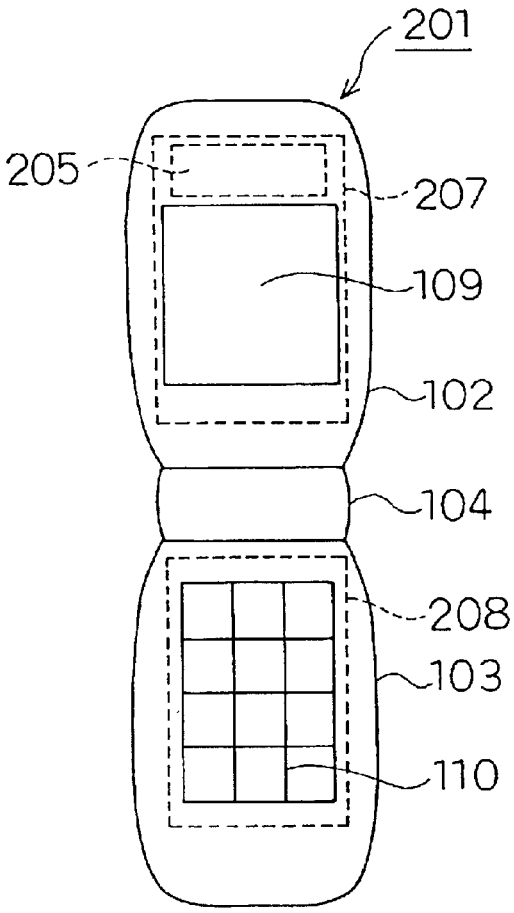
FIG. 20(*a*) is a front view of the conventional folding cellular phone terminal only having an internal antenna.
Figure 20:
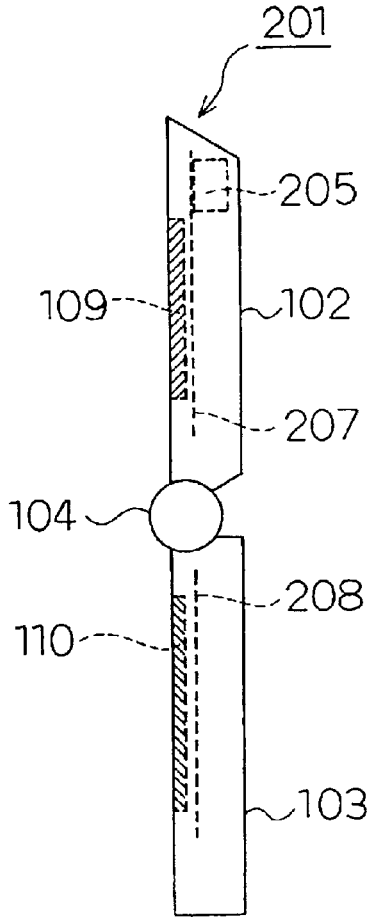

Now, a seventh embodiment will be described. FIG. 18 is a block diagram showing a communication device 1001 according to this embodiment. An example of the communication device 1001 is a cellular phone terminal. In FIG. 18, a transmission signal output from a transmitter circuit is transmitted to a mixer 1003 through a filter 1002. The transmission signal input to the mixer 1003 is up-converted with a local signal from an oscilator 1004 and transmitted to an antenna 1009*a* or 1009*b* through a transmission filter 1005, an amplifier 1006, a transmission filter 1007 and a switch 1008. A reception signal received by the antenna 1009*a* or 1009*b* is input to a mixer 1013 via the switch 1008, a reception filter 1010, an amplifier 1011 and a reception filter 1012. The reception signal input to the mixer 1013 is down-converted with a local signal from the oscilator 1004 and transmitted to a receiver circuit through a filter 1014.

Here, by using the upper internal antenna and the lower internal antenna described above in the embodiments as the antennas 1009*a* and 1009*b,* respectively, the communication device can be shortened. Alternatively, by using the housing antenna and the boom antenna as the antennas 1009*a* and 1009*b,* respectively, the communication device can be shortened.

While the switch 1008, connected to the antennas 1009*a* and 1009*b,* separates the transmission signal and the reception signal in this embodiment, it may be replaced with a duplexer.

This invention includes the communication device comprising the antenna structure according to this invention, the transmitter circuit that outputs the transmission signal to the first or second antenna, and the receiver circuit that receives the reception signal received by the first or second antenna.

As described above, by using a plurality of antennas each of which exhibits a good characteristic when the cellular phone terminal is used with being folded or without being folded, the antenna can be downsized and slimmed and a slimmed cellular phone terminal can be provided compared to the case where one antenna is configured to exhibit a satisfactory characteristic when the cellular phone terminal is used with being folded and without being folded.

The upper internal antenna according to this embodiment is an example of a first antenna according to this invention, the lower internal antenna according to this embodiment is an example of a second antenna according to this invention, the upper housing according to this embodiment is an example of a first housing part according to this invention, the lower housing according to this embodiment is an example of a second housing part according to this invention, the 800 MHz-band in this embodiment is an example of a low frequency band in this invention, and the 1.5 GHz-band in this embodiment is an example of a high frequency band in this invention.

As can be seen from the above description, this invention can provide an antenna structure that enables a folding cellular phone terminal to be slimmed further, a method of using the antenna structure and a communication device.

What is claimed is:

1. An antenna structure used in a folding portable radio terminal, comprising:

a first antenna; and a second antenna, said first antenna used at least when said portable radio terminal is not folded, said second antenna used at least when said portable radio terminal is folded, wherein when said portable radio terminal is not folded, a divesity reception is carried out with said first antenna serving as a main antenna an said second antenna serving as a sub-antenna, and when said portable radio terminal is folded, a diversity reception is carried out with said first antenna serving as a sub-antenna and said second and antenna serving as a main antenna.

2. An antenna structure used in a folding portable radio terminal, comprising:

a first antenna; and a second antenna, said first antenna used at least when said portable radio terminal is not folded, said second antenna used at least when said portable radio terminal is folded, wherein when said portable radio terminal is not folded, a diversity transmission is carried out with said first antenna serving as a main antenna and said second antenna serving as a sub-antenna, and when said portable radio terminal is folded, a diversity transmission is carried out with said first antenna serving as a sub-antenna and said second antenna serving as a main antenna.

3. An antenna structure used in a folding portable radio terminal, comprising:

a first antenna;

a second antenna, said first antenna used at least when said portable radio terminal is not folded, said second antenna used at least when said portable radio terminal is folded, a first housing part that incorporates a speaker of said portable radio terminal therein, and a second housing part that incorporates a microphone of said portable radio terminal therein, wherein said first housing part and said second housing part are capable of being folded, said first antenna is disposed in said first housing part, and said second antenna is disposed in said second housing part.

4. The antenna structure according to claim 3, wherein when said portable radio terminal is not folded, a diversity reception is carried out with said first antenna serving as a main antenna and said second antenna serving as a sub-antenna, and when said portable radio terminal is folded, a diversity reception is carried out with said first antenna serving as a sub-antenna and said second antenna serving as a main antenna.

5. The antenna structure according to claim 3, wherein when said portable radio terminal is not folded, a diversity transmission is carried out with said first antenna serving as a main antenna and said second antenna serving as a sub-antenna, and when said portable radio terminal is folded, a diversity transmission is carried out with said first antenna serving as a sub-antenna and said second antenna serving as a main antenna.

6. The antenna structure according to claim 3, wherein said first antenna has a better characteristic when said portable radio terminal is not folded, and said second antenna has a better characteristic when said portable radio terminal is folded.

7. The antenna structure according to claim 3, wherein said first antenna is an internal antenna incorporate in said first housing part, and said second antenna is an internal antenna incorporated in said second housing part.

8. The antenna structure according to claim 3, wherein said first antenna comprises an antenna element and a bottom board for said antenna element.

9. The antenna structure according to claim 8, further comprising:

a display disposed in said first housing part, wherein said display and said antenna element face each other, and a part of said display is conductive and serves also as said bottom board.

10. The antenna structure according to claim 9, wherein said display includes a display main body, a frame disposed around said display main body and a reflection plate disposed at the back side of a screen of said display main body, and whole or a part of said reflection plate is conductive and serves also as said bottom board.

11. The antenna structure according to claim 9, wherein said display includes a display main body and a frame disposed around said display main body, and whole or a part of said frame is conductive and serves also as said bottom board.

12. The antenna structure according to any one of claims 3, 1, and 2 wherein one of said first and second antennas, which is not used, serves as a passive element for the other, which is used.

13. The antenna structure according to claim 12, wherein when said first housing part and said second housing part are folded on each other, for reception, diversity reception is carried out at said first antenna and said second antenna, and for transmission, said second antenna is used with said first antenna serving as the passive element, and when said first housing part and said second housing part are not folded on each other, for reception, diversity reception is carried out at said first antenna and said second antenna, and for transmission, one of said first and second antennas which has a higher reception level is used with the other, which has a lower reception level, serving as the passive element.

14. The antenna structure according to claim 12, wherein when said first housing part and said second housing part are folded on each other, for reception, diversity reception is carried out at said first antenna and said second antenna, and for transmission, one of said first and second antennas which has a higher reception level is used with the other, which has a lower reception level, serving as the passive element, and when said first housing part and said second housing part are not folded on each other, for reception, diversity reception is carried out at said first antenna and said second antenna, and for transmission, said first antenna is used with said second antenna serving as the passive element.

15. The antenna structure according to claim 12, wherein when said first housing part and said second housing part are folded on each other, for reception, diversity reception is carried out at said first antenna and said second antenna, and for transmission, said second antenna is used with said first antenna serving as the passive element, and when said first housing part and said second housing part are folded on each other, for reception, diversity reception is carried out at said first antenna and said second antenna, and for transmission, said first antenna is used with said second antenna serving as the passive element.

16. The antenna structure according to claim 12, wherein when said first housing part and said second housing part are folded on each other, for reception, diversity reception is carried out at said first antenna and said second antenna, and for transmission, one of said first and second antennas which has a higher reception level is used with the other, which has a lower reception level, serving as the passive element, and when said first housing part and said second housing part are not folded on each other, for reception, diversity reception is carried out at said first antenna and said second antenna, and for transmission, one of said first and second antennas which has a higher reception level is used with the other, which as a lower reception level, serving as the passive element.

17. The antenna structure according to claim 12, wherein said antenna which is not used has a load adjusted so that said antenna which is used has a predetermined directivity and a wide band frequency characteristic.

18. The antenna structure according to claim 3, wherein a thickness of each of said first antenna and said second antenna is less than a thickness of said portable radio terminal determined by components thereof other than said first and second antennas.

19. The antenna structure according to claim 3, wherein whole or a part of said first antenna and/or second antenna is filled with a dielectric.

20. The antenna structure according to claim 3, further comprising:

a first housing part that incorporates a speaker of said portable radio terminal; and a second housing part that incorporates a microphone of said portable radio terminal, wherein said first housing part serves also as said first antenna, and said second antenna is a boom antenna disposed in said second housing part.

21. The antenna structure according to claim 20, wherein a part of said first housing part opposite to the side where the display is incorporated is made of a conductive material, and the part of said first housing part made of a conductive material serves also as said first antenna.

22. The antenna structure according to claim 21, wherein said first housing part has a slit or slot formed in said part made of conductive material, and said first antenna and said second antenna are used for a high frequency band and a low frequency band.

23. A communication device, comprising:

the antenna structure according to claim 3;

a transmitter circuit that outputs a transmission signal to said first antenna or second antenna; and a receiver circuit that receives a reception signal received at said first antenna or second antenna.

24. An antenna structure used in a folding portable radio terminal, comprising:

a first housing part that incorporates a speaker therein;

a second housing part that incorporates a microphone therein;

a first antenna; and a second antenna, wherein said first housing part and said second housing part are capable of being folded on each other, said first antenna includes an antenna element and a bottom board for said antenna element, said antenna element is disposed in said first housing part, said bottom board is disposed over said first housing part and second housing part, for a low frequency band, said first antenna is used at least when said first housing part and said second housing part are not folded on each other, for said low frequency band, said second antenna is used at least when said first housing part and said second housing part are folded on each other, for a high frequency band, said first antenna is used at least when said first housing part and said second housing part are folded on each other, and for said high frequency band, said second antenna is used at least when said first housing part and said second housing part are not folded on each other.

25. The antenna structure according to claim 24, wherein for said low frequency band, said first antenna has a better characteristic when said first housing part and said second housing part are not folded on each other, and for said high frequency band, said first antenna has a better characteristic when said first housing part and said second housing part are folded on each other, and for said low frequency band, said second antenna has a better characteristic when said first housing part and said second housing part are folded on each other, and for said high frequency band, said second antenna has a better characteristic when said first housing part and said second housing part are not folded on each other.

26. The antenna structure according to claim 8 or 24, wherein a part of said first housing part and/or second housing part is conductive, and said conductive part is used as said bottom board.

27. The antenna structure according to claim 26, wherein a part of said first housing part is not conductive, the part facing said antenna element and extending away from a connection of said first housing part with said second housing part from an end of said antenna element opposite to the connection.

28. The antenna structure according to claim 26, wherein a part of said first housing part which faces said second antenna when said first housing part and said second housing part are folded on each other is not conductive.

29. A communication device, comprising:

the antenna structure according to claim 24;

a transmitter circuit that outputs a transmission signal to said first antenna or second antenna; and a receiver circuit that receives a reception signal received at said first antenna or second antenna.

30. A method of using an antenna structure used in a folding portable radio terminal, the antenna structure comprising:

a first antenna;

a second antenna, said first antenna used at least when said portable radio terminal is not folded, said second antenna used at least when said portable radio terminal is folded, a first housing part that incorporates a speaker of said portable radio terminal therein, and a second housing part that incorporates a microphone of said a portable radio terminal therein, wherein said first housing part and said second housing part are capable of being folded, said first antenna is disposed in said first housing part, and said second antenna is disposed in said second housing part.

31. A method of using an antenna structure, the antenna structure comprising:

a first housing part that incorporates a speaker therein;

a second housing part that incorporates a microphone therein;

a first antenna; and a second antenna, said first housing part and said second housing part being capable of being folded on each other, said first antenna including an antenna element and a bottom board, said antenna element being disposed in said first housing part, and said bottom board being disposed over said first housing part and second housing part, wherein for a low frequency band, said first antenna is used least when said first housing part and said second housing part are not folded on each other, for said low frequency band, said second antenna is used at least when said first housing part and said second housing part are folded on each other, for a high frequency band, said first antenna is used at least when said first housing part and said second housing part are folded on each other, and for said high frequency band, said second antenna is used at least when said first housing part and said second housing part are not folded on each other.

* * * * *

UNITED STATES PATENT AND TRADEMARK OFFICE

CERTIFICATE OF CORRECTION

PATENT NO. : 6,806,835 B2
DATED : October 19, 2004
INVENTOR(S) : Iwai et al.

It is certified that error appears in the above-identified patent and that said Letters Patent is hereby corrected as shown below:

Column 23,
Line 50, “divesity” should read -- diversity --

Column 24,
Line 48, “incorporate” should read -- incorporated --

Column 25,
Line 62, “as” should read -- has --

Column 28,
Line 4, after the word “said” delete “a”

Signed and Sealed this

Twenty-sixth Day of April, 2005

JON W. DUDAS
*Director of the United States Patent and Trademark Office*